US011359368B2

(12) United States Patent
MacDonald et al.

(10) Patent No.: US 11,359,368 B2
(45) Date of Patent: Jun. 14, 2022

(54) VENTILATING SILL PLATE

(71) Applicant: 9619674 CANADA INC., Kirkland (CA)

(72) Inventors: James MacDonald, Kirkland (CA); Vincent Begin, Westmount (CA); Louise Charbonneau, Montreal (CA); Mado Poulin, Quebec (CA); Eric LeClair, Adstock (CA); Steven Arless, Baie d'Urfe (CA)

(73) Assignee: 9619674 CANADA INC., Kirkland (CA)

( * ) Notice: Subject to any disclaimer, the term of this patent is extended or adjusted under 35 U.S.C. 154(b) by 0 days.

(21) Appl. No.: 16/981,006

(22) PCT Filed: Apr. 18, 2019

(86) PCT No.: PCT/IB2019/053241
§ 371 (c)(1),
(2) Date: Sep. 15, 2020

(87) PCT Pub. No.: WO2019/202552
PCT Pub. Date: Oct. 24, 2019

(65) Prior Publication Data

US 2021/0025161 A1 Jan. 28, 2021

Related U.S. Application Data

(60) Provisional application No. 62/659,739, filed on Apr. 19, 2018, provisional application No. 62/767,595, filed on Nov. 15, 2018.

(51) Int. Cl.
*E04B 1/70* (2006.01)
*E04B 1/64* (2006.01)

(52) U.S. Cl.
CPC ..... *E04B 1/7076* (2013.01); *E04B 1/644* (2013.01)

(58) Field of Classification Search
CPC ..... E04B 1/7076; E04B 1/644; E04B 2001/2463; E04B 2001/268; F24F 13/082
See application file for complete search history.

(56) References Cited

U.S. PATENT DOCUMENTS 2,122,926 A * 7/1938 Blacher ..... E04B 1/644 52/302.6
2,859,486 A * 11/1958 Rovich ..... E04B 1/644 52/198

(Continued)

FOREIGN PATENT DOCUMENTS

JP 2006057440 A * 3/2006
WO WO-2020242003 A1 * 12/2020 ..... E02D 27/01

OTHER PUBLICATIONS

International Preliminary Report on Patentability for PCT/IB2019/053241 (6 pages). (Year: 2020).*

*Primary Examiner* — Rodney Mintz
(74) *Attorney, Agent, or Firm* — Fasken Martineau Dumoulin LLP; Serge Lapointe

(57) ABSTRACT

There is provided a ventilating sill plate for elevating a wall portion from a receiving surface. The ventilating sill plate comprises at least one longitudinal base having a first and a second face opposite the first face extending along a longitudinal axis, the first and the second face extending laterally perpendicular to the longitudinal axis between a first and a second lateral side. A plurality of longitudinally spaced support legs extend away from the second face and define at least one ventilating channel extending from the first to the second lateral side of the at least one longitudinal base. A plurality of support pads project from the first face and collaborate for supporting the wall portion. A plurality of (Continued)

longitudinally spaced arms are shaped and sized to receive the wall portion therebetween.

20 Claims, 10 Drawing Sheets

(56) References Cited

U.S. PATENT DOCUMENTS 3,314,201 A * 4/1967 Riegelman ..... E06B 7/14 52/209
3,374,589 A * 3/1968 Neal, Jr. ..... E04G 21/22 52/105
5,218,793 A * 6/1993 Ball ..... E04B 1/70 52/169.5
5,468,184 A * 11/1995 Collier ..... F24F 7/08 454/186
5,678,362 A * 10/1997 Hulls ..... E04B 1/72 43/124
6,003,279 A * 12/1999 Schneider ..... E04B 1/0046 403/230
6,032,429 A * 3/2000 Choi ..... E04B 1/644 52/311.1
RE36,676 E * 5/2000 Sourlis ..... E04B 1/644 52/169.5
6,578,332 B2 * 6/2003 Bushberger ..... E04B 1/644 52/274
6,647,691 B2 * 11/2003 Becker ..... E04B 2/7457 52/656.1
6,669,554 B1 * 12/2003 Tregidga ..... E04B 1/7076 454/254
6,941,703 B2 * 9/2005 MacLean ..... A01K 1/0103 137/312
8,099,912 B2 * 1/2012 DeJonge ..... F24F 13/082 52/126.2
8,555,586 B2 * 10/2013 Lowe ..... E03F 1/005 52/310
D711,020 S * 8/2014 Cochren ..... E04B 1/68 D25/113
9,085,891 B2 * 7/2015 Horton, III ..... E04B 1/644
9,085,892 B1 * 7/2015 Wilson ..... E04F 17/00
9,988,809 B2 * 6/2018 Montminy ..... E04B 1/4178
10,047,518 B2 * 8/2018 MacDonald ..... E04C 2/523
2002/0062610 A1 * 5/2002 Bushberger ..... E04B 1/644 52/293.3
2003/0074852 A1 * 4/2003 Knabenschuh ..... E04B 1/68 52/396.02
2006/0026911 A1 * 2/2006 Sutton ..... E04B 2/789 52/169.5
2009/0223147 A1 * 9/2009 Spignesi ..... E04F 17/00 52/169.5
2011/0225911 A1 * 9/2011 Battisti ..... E04B 2/7409 52/302.1
2014/0345217 A1 * 11/2014 Horton, III ..... E04B 1/644 52/293.1
2016/0340893 A1 * 11/2016 MacDonald ..... E04B 1/7076
2018/0100314 A1 * 4/2018 Montminy ..... E04B 2/32

* cited by examiner

VENTILATING SILL PLATE

CROSS REFERENCE TO RELATED APPLICATIONS

The present application is a U.S. National Phase Application pursuant to 35 U.S.C § 371 of International Application No. PCT/IB2019/053241 filed Apr. 18, 2019, which claims priority to U.S. Provisional Patent Application No. 62/767,595 filed Nov. 15, 2018 and to U.S. Provisional Patent Application No. 62/659,739 filed Apr. 19, 2018. The entire disclosure contents of these applications are herewith incorporated by reference into the present application.

FIELD

The present technology relates to ventilating plates in general and more particularly to a ventilating sill plate for elevating a wall portion from a floor.

BACKGROUND

Ventilating an interior of a building or a house to recycle air is necessary to provide quality ambient air to persons within a room. Further, it is also important to ventilate the interior of a building or house to prevent formation and accumulation of moisture and humidity which may damage wall structures and facilitate mold growth.

For example, closed garages are places where moisture is prone to form. As moisture in the air contacts a cold surface, such as the floor surface of a garage, it may facilitate the accumulation of water droplets which may deteriorate a wall portion by the formation of fungus, mold and wood rot.

In some cases, houses structures such as walls are made of wood beams known as two-by-four (2"×4") beam studs. In other cases, metal studs such as steel studs having U channel, C channel or I channel shapes may be preferred considering the difference in price with wood but also because they are lighter than wood and because they are not subject to fire and have an increased stiffness.

However, in both cases, these wall structures can be subject to rust, moisture and humidity accumulation if no ventilation is provided.

In some cases, wall structure ventilation devices are installed under a wall structure, and usually comprise a support surface having opposed plate sections, extending upwardly for supporting the lower end of the wall structure and elevating the lower end from the ground. Further, some ventilation devices may also comprise ventilating channels for venting air under the wall structure.

However, while such ventilating devices enable preventing a wall from being in contact with the ground and in contact with water in case of water flooding, the wall is usually in contact with the support surface of the ventilation device. This arrangement typically facilitates the accumulation of moisture and the formation of rust.

Other devices such as vapor barrier membranes made from polymers may be used to isolate wall structures from humidity. However, such vapor barrier membranes may cause moisture and fluid such as water to accumulate and become trapped in case of a water damage or flooding.

SUMMARY

It is an object of the present technology to ameliorate at least some of the inconveniences present in the prior art.

In accordance with a first broad aspect, there is provided a ventilating sill plate for elevating a wall portion from a receiving surface, the ventilating sill plate comprising: at least one longitudinal base having a first face and a second face opposite the first face, the first face and the second face extending along a longitudinal axis, the first face and the second face extending laterally in a direction perpendicular to the longitudinal axis between a first lateral side and a second lateral side; a plurality of longitudinally spaced support legs projecting away from the second face of the at least one longitudinal base, two adjacent ones of the plurality of longitudinally spaced support legs defining a ventilating channel extending therebetween; a plurality of longitudinally spaced elevated support pads each projecting from the first face and each comprising a support surface collaborating for supporting the wall portion; and a plurality of arms comprising a first set of longitudinally spaced arms and a second set of longitudinally spaced arms, the first set of longitudinally spaced arms projecting away from the first face of the at least one longitudinal base and mounted adjacent to the first lateral side, the second set of longitudinally spaced arms projecting away from the first face of the at least one longitudinal base and mounted adjacent to the second lateral side, the first set of longitudinally spaced arms and the second set of longitudinally spaced arms being designed so as to receive the wall portion therebetween.

In one embodiment, the at least one longitudinal base comprises a single longitudinal plate having the first face and the second face and extending laterally between the first lateral side and the second lateral side.

In one embodiment, the plurality of longitudinally spaced elevated support pads extend between the first lateral side and the second lateral side of the at least one longitudinal base.

In one embodiment, the first face of the single longitudinal plate is inclined so as to allow evacuation of water.

In one embodiment, the first face of the single longitudinal plate is provided with a V-shape so that a first portion of the first face is inclined from an apex towards the first lateral side and a second portion of the first face is inclined from the apex towards the second lateral side.

In one embodiment, the at least one longitudinal base comprises a first longitudinal base and a second longitudinal base, the first longitudinal base being spaced apart from the second longitudinal base along a lateral axis by a gap; the first longitudinal base is provided with a first surface and a second surface opposite the first surface, the first surface and the second surface extending along the longitudinal axis; the second longitudinal base is provided with a third surface and a fourth surface opposite the second surface, the third surface and the fourth surface extending along the longitudinal axis; the first set of longitudinally spaced arms each project away from a first surface of the first longitudinal base adjacent a first lateral end of the first longitudinal base; the second set of longitudinally spaced arms each project away from a third surface of the second longitudinal base adjacent a first lateral end of the second longitudinal base, the first lateral end of the first longitudinal base being laterally opposite to. the first lateral end of the second longitudinal base; each one of the a plurality of longitudinally spaced support legs is mounted to the second surface of the first longitudinal base and the fourth surface of the second longitudinal base; and each one of the plurality of longitudinally spaced elevated support pads is mounted on a respective one of the first surface of the first longitudinal base and the third surface of the second longitudinal base.

In one embodiment, the plurality of longitudinally spaced elevated support pads comprises a first set of supporting pads projecting from the first surface of the first longitudinal base and a second set of supporting pads projecting from the third surface of the second longitudinal base, each one of the first set of supporting pads laterally facing a respective one of the second set of mounting pads.

In one embodiment, each one of the a plurality of longitudinally spaced support legs is provided with a recess facing the gap between the first and second longitudinal bases.

In one embodiment, the at least one longitudinal base further comprises a central longitudinal base mounted to the plurality of longitudinally spaced support legs within the recess thereof, the central longitudinal base being spaced apart from the first and second longitudinal bases.

In one embodiment, the ventilating sill plate further comprises a plurality of notches each securing the central longitudinal base to a respective one of the first and second longitudinal bases.

In one embodiment, the second face of the at least one longitudinal base comprises at least one longitudinal reinforcement member extending along the longitudinal axis between a first longitudinal end and a second longitudinal end of the at least one longitudinal base.

In one embodiment, each support pad extends between the first lateral side and the second lateral side of the at least one longitudinal base and comprises at least one reinforcement section.

In one embodiment, two consecutive support pads of the plurality of support pads define a draining channel extending between the first lateral side and the second lateral side of the at least one longitudinal base.

In one embodiment, the first set of arms is in a staggered arrangement relative to the second set of arms.

In one embodiment, each arm of the plurality of arms is L-shaped.

In one embodiment, each arm of the plurality of arms comprises a pressure surface facing the at least one longitudinal base and parallel to the longitudinal axis, the pressure surface extending between a lower portion connected to the at least one longitudinal base and an upper portion, the pressure surface comprising at least one pressure rib projecting therefrom towards the at least one longitudinal base and configured to contact the wall portion as it is positioned on the support pads.

In one embodiment, the plurality of arms are flexible in a plane perpendicular to the longitudinal axis.

In one embodiment, the first set of arms is secured at the first lateral side of the at least one longitudinal base, and the second set of arms is secured at the second lateral side of the at least one longitudinal base.

In one embodiment, each support leg comprises a plurality of vertical reinforcement members.

According to another broad aspect, there is provided a ventilating sill plate for elevating a wall portion from a receiving surface, the ventilating sill plate comprising: a longitudinal base having a first face and a second face each extending along a longitudinal axis between a first longitudinal end and a second longitudinal end, the longitudinal base further extending laterally in a direction perpendicular to the longitudinal axis between a first lateral side and a second lateral side; a plurality of longitudinally spaced support legs extending from the second face of the longitudinal base between the first lateral side and the second lateral side thereof, the plurality of spaced support legs defining ventilating channels; a plurality of longitudinally spaced elevated support pads projecting from the first face, the plurality of spaced elevated pads each comprising a support surface collaborating for supporting the wall portion; and a plurality of arms comprising a first set of longitudinally spaced arms projecting from the first face at the first lateral side of the base and a second set of longitudinally spaced arms projecting from the first face at the second lateral side of the at least one longitudinal base, the distance between the first set of arms and the second set of arms adapted to receive the wall portion.

According to a further broad aspect, there is provided a ventilating sill plate for elevating a wall portion from a receiving surface, the ventilating sill plate comprising: a first and a second longitudinal bases, each of the longitudinal bases having a first face and a second face each extending along a longitudinal axis between a first longitudinal end and a second longitudinal end, each of the longitudinal bases further extending laterally in a direction perpendicular to the longitudinal axis between a first lateral side and a second lateral side, the first and second longitudinal bases being operatively mounted side by side in a spaced apart relationship; a plurality of longitudinally spaced support legs projecting vertically away from the second face of each of the bases and between corresponding lateral sides thereof extending outwards, the plurality of spaced support legs defining ventilating channels therebetween; a plurality of elevated support pads comprising a first set of longitudinally spaced support pads projecting from the first face of the first longitudinal base and a second set of longitudinally spaced support pads projecting from the first face of the second longitudinal base, each of the elevated pads comprising a support surface adapted for supporting the wall portion thereon; and a plurality of arms defining a first set of longitudinally spaced arms projecting from the first face at a corresponding lateral side of the first base projecting outwards and a second set of longitudinally spaced arms projecting from the first face at a corresponding lateral side of the second base projecting outwards, a distance between the first set of arms and the second set of arms being adapted to receive the wall portion.

In one embodiment, the ventilating sill plate further comprises a central longitudinal base longitudinally mounted between the first and second longitudinal bases, the central base having a first face defining a recessed portion between the first faces of the first longitudinal base and the second longitudinal base.

Implementations of the present technology each have at least one of the above-mentioned object and/or aspects, but do not necessarily have all of them. It should be understood that some aspects of the present technology that have resulted from attempting to attain the above-mentioned object may not satisfy this object and/or may satisfy other objects not specifically recited herein.

Additional and/or alternative features, aspects and advantages of implementations of the present technology will become apparent from the following description, the accompanying drawings and the appended claims.

BRIEF DESCRIPTION OF THE DRAWINGS

For a better understanding of the present technology, as well as other aspects and further features thereof, reference is made to the following description which is to be used in conjunction with the accompanying drawings, where.

DETAILED DESCRIPTION

Modifications and improvements to the above-described implementations of the present technology may become apparent to those skilled in the art. The foregoing description is intended to be exemplary rather than limiting. The scope of the present technology is therefore intended to be limited solely by the scope of the appended claims.

Figure 1:
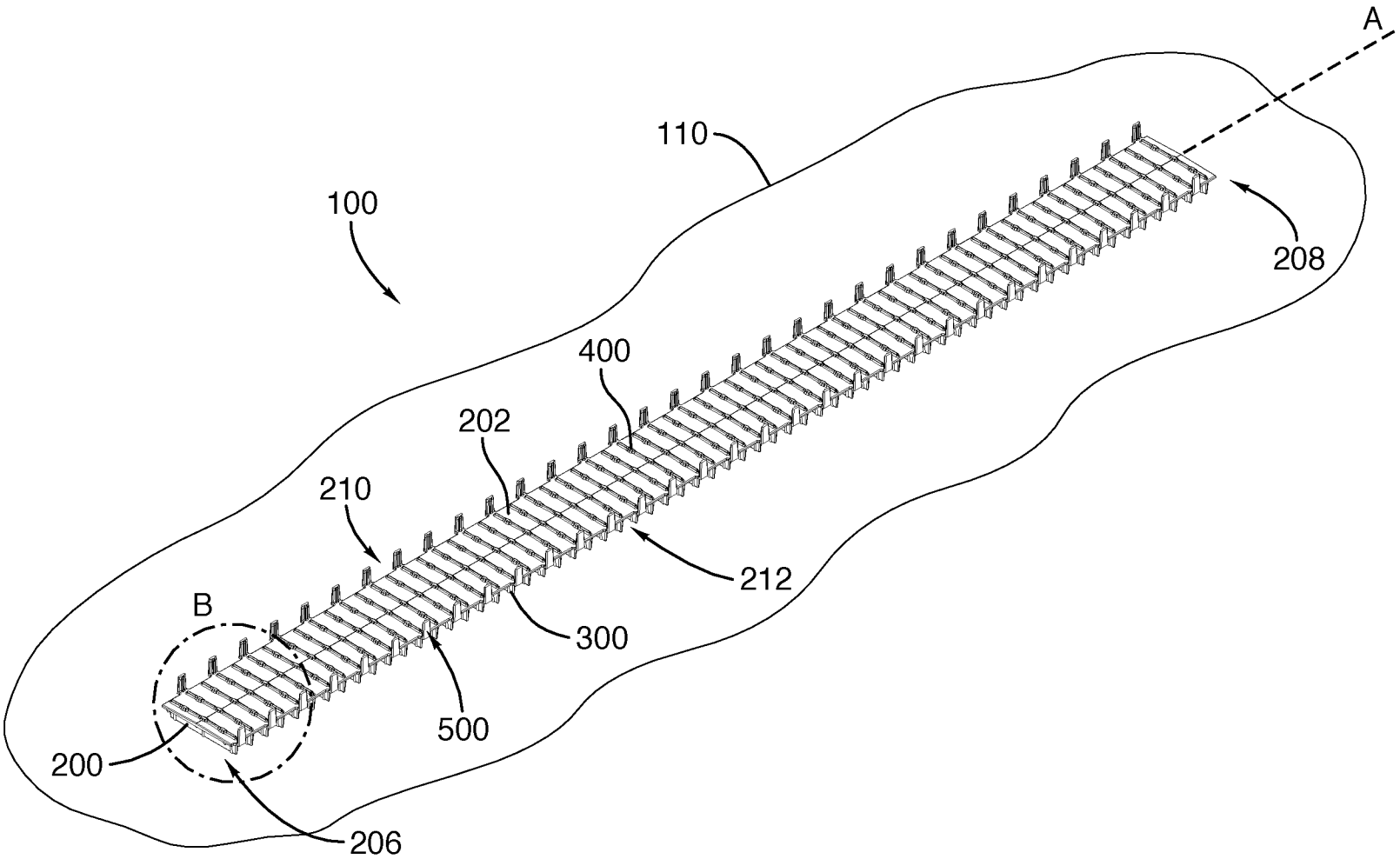
FIG. 1 illustrates a top perspective view of a ventilating sill plate in accordance with a non-limiting embodiment of the present technology.
Figure 2:
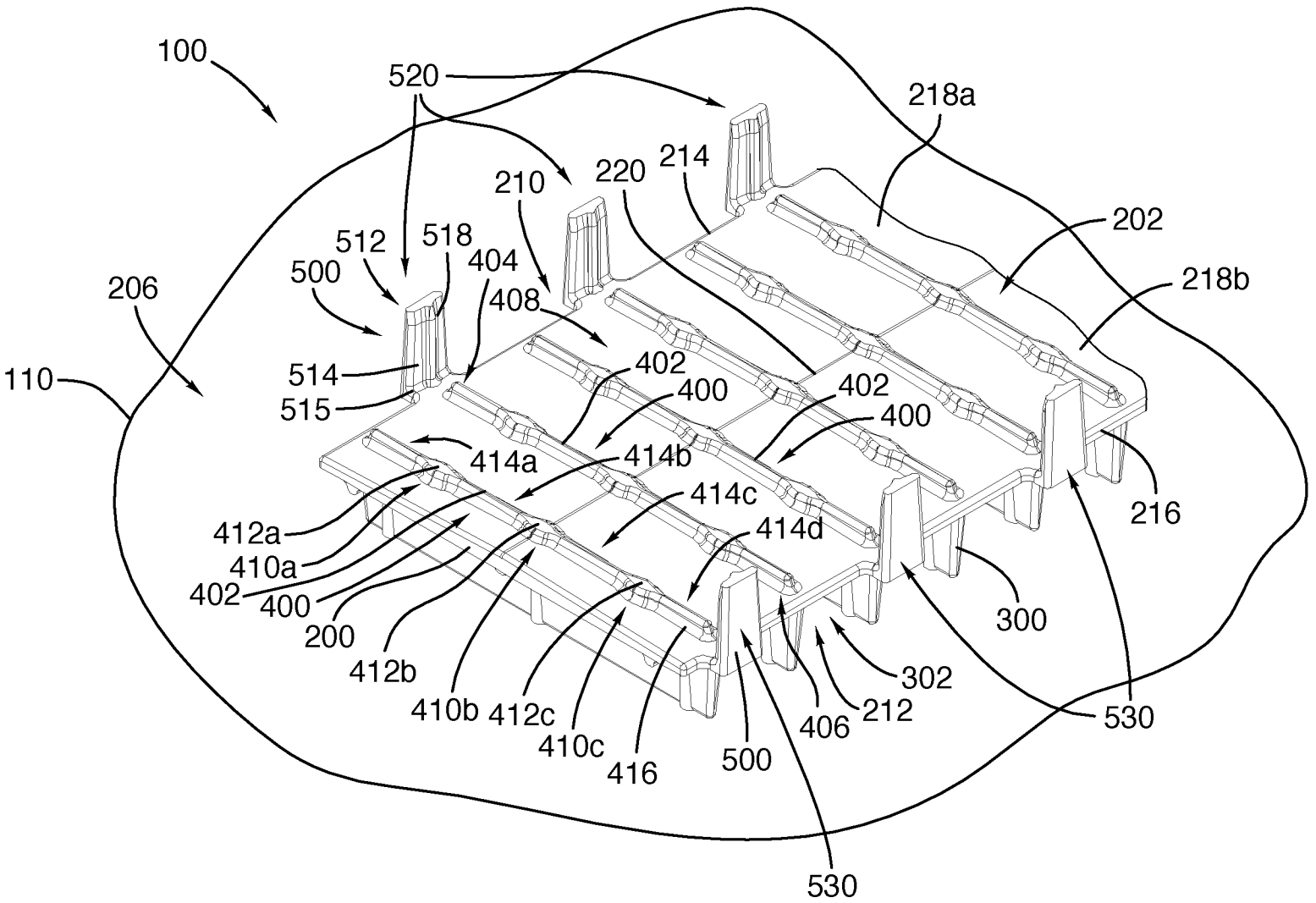
FIG. 2 illustrates a top perspective view taken along section B of the ventilating sill plate of FIG. 1 in accordance with a non-limiting embodiment of the present technology.

With reference to FIGS. 1 and 2, there is depicted a ventilating sill plate 100 for elevating a wall portion (not shown) from a receiving surface 110 in accordance with a non-limiting embodiment of the present technology. As a non-limiting example, the receiving surface 110 may be a ground floor.

In one non-limiting embodiment of the present technology, the ventilating sill plate 100 elevates and isolates the wall portion from moisture and humidity that can emanate from the receiving surface 110. As a person skilled in the art may appreciate, moisture and humidity could form in closed rooms or spaces that are not well ventilated. As a non-limiting example, closed garages are places where moisture is prone to form. As moisture in the air contacts a cold surface, such as a floor surface of a garage, it may facilitate the accumulation of water droplets which may deteriorate a wall portion by the formation of fungus, mold and wood rot. It is contemplated that the ventilating sill plate 100 could be placed under a floor joist for preventing accumulation of humidity and moisture thereunder.

The ventilating sill plate 100 comprises inter alia a base plate 200, a plurality of support legs 300, a plurality of support pads 400, and a plurality of arms 500.

The ventilating sill plate 100 has a base plate 200 having a generally elongated longitudinal shape, the base plate 200 having a first face 202 and a second face 204 opposing the first face 202. The first face 202 and the second face 204 extend along a longitudinal axis A, between a first longitudinal end 206 and a second longitudinal end 208. The first face 202 and the second face 204 of the base plate 200 further extend laterally in a direction perpendicular to the longitudinal axis A between a first lateral side 210 and a second opposing lateral side 212.

The ventilating sill plate 100 has a plurality of support legs 300 structured and dimensioned to elevate the base plate 200 from the receiving surface 110. The plurality of support legs 300 project from the second face 204 of the base plate 200 towards the receiving surface 110, and extend laterally between the first lateral side 210 and the second lateral side 212 of the base plate 200. The plurality of support legs 300 are in a longitudinally spaced arrangement along the longitudinal axis A of the base plate 200, and define a plurality of ventilating channels 302 which enable air circulation between opposite lateral sides of the ventilating sill plate 100 to prevent the accumulation of moisture and humidity on the wall portion (not depicted).

The ventilating sill plate 100 has a plurality of elevated support pads 400 on the first face 202 for supporting the wall portion (not depicted). The support pads 400 project from the first face 202 of the base plate 200 and are in a longitudinally spaced arrangement along the longitudinal axis A of the base plate 200. Each of the support pads 400 has a respective support surface 402 collaborating for supporting the wall portion (not depicted) as it is positioned on the ventilating sill plate 100.

The ventilating sill plate 100 has a plurality of arms 500 for guiding and maintaining the wall portion (not depicted) as it is positioned on the support pads 400. The plurality of arms 500 are disposed in a longitudinally spaced arrangement along the longitudinal axis A of the base plate 200. The plurality of arms 500 project from the first lateral side 210 and the second lateral side 212, and extend vertically away from the first face 202. The plurality of arms 500 include a first set of arms 520 projecting in a direction away from the first face 202 at the first lateral side 210 of the base plate 200, and a second set of arms 530 projecting in a direction away from the first face 202 at the second lateral side 212 of the base plate 200.

In one non-limiting embodiment of the present technology, a lateral distance between vertical portions of the first set of arms 520 and the second set of arms 530 of the plurality of arms 500 is adapted to receive the wall portion (not depicted).

Referring now to FIGS. 2 to 6, the base plate 200 will be described in more detail. The base plate 200 has the first face 202 and the second face 204 linked at a first edge 214 at the first lateral side 210 of the base plate 200, and at a second edge 216 at the second lateral side 212 of the base plate 200.

In some non-limiting embodiment of the present technology, the first face 202 of the base plate 200 has a cambered shape (as seen from a front elevation view) for allowing drainage of water accumulating on the first face 202 of the ventilating sill plate 100. In the embodiment depicted in FIG. 3, the first face 202 comprises a pair of inclined surfaces including a first inclined surface **218*a* and a second inclined surface 218*b* defining an inverted V-shape. In this embodiment, the first inclined surface 218*a* and the second inclined surface 218*b* extend from the first lateral side 210 and the second lateral side 212 of the base plate 200, respectively, and join at an apex 220 located between the first lateral side 210 and the second lateral side 212 of the base plate 200**.

In one non-limiting embodiment of the present technology, the first inclined surface **218*a* and the second inclined surface 218*b* of the first face 202 of the base plate 200 allow drainage of water which may accumulate under the wall portion (not depicted). More precisely, the first inclined surface 218***a* and the second inclined surface 218*b* prevent the retention of water under the wall portion and enable the water droplets, falling thereon, to be guided by gravity towards the first lateral side 210 and the second lateral side 212 of the base plate 200 and be discharged therefrom, as it will be explained in further detail herein below.

Figure 3:
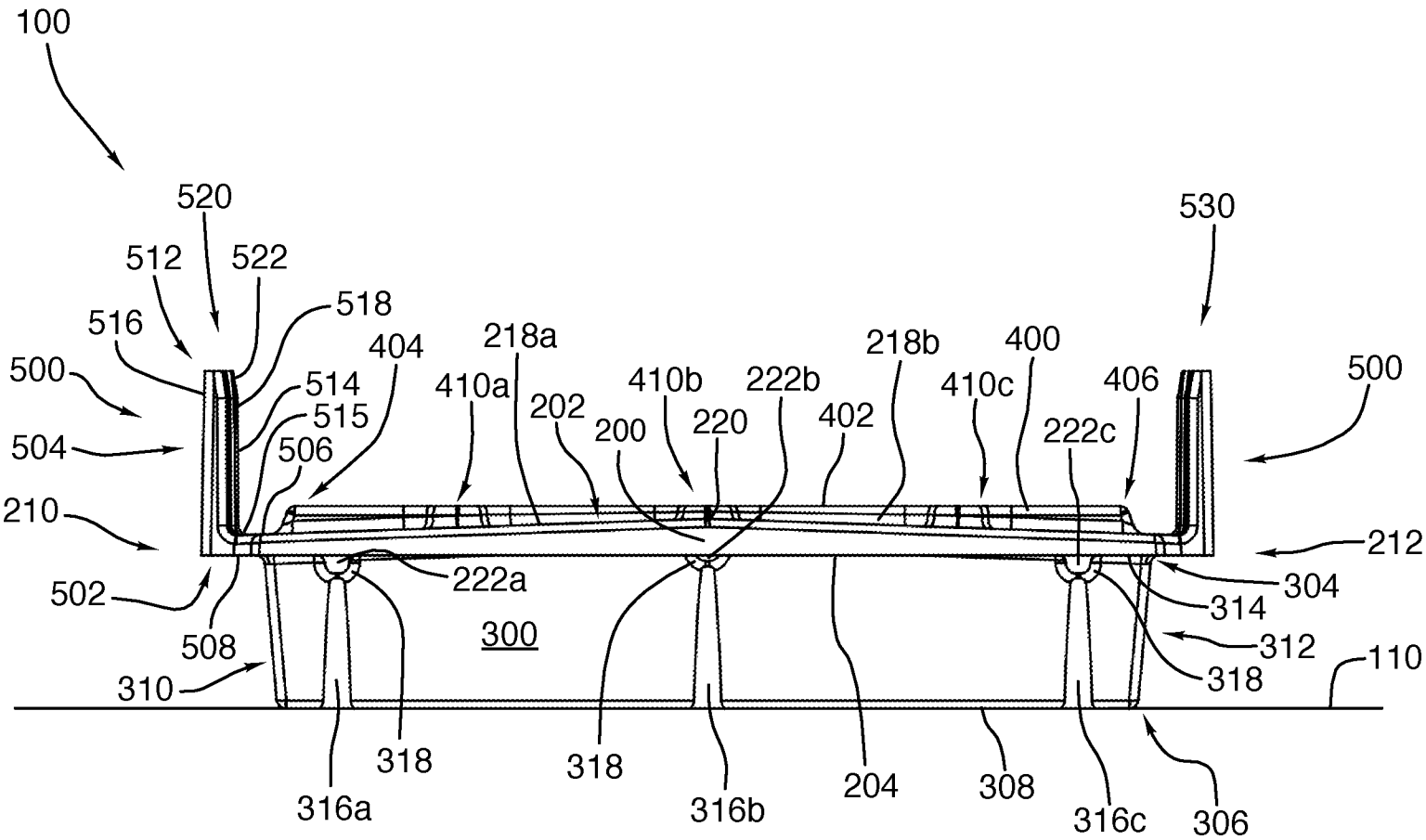
FIG. 3 illustrates a front side view of the ventilating sill plate of FIG. 1, showing a cross section of a base plate.

In the embodiment depicted in FIG. 3, the apex 220 is located at equal distance between the first lateral side 210 and the second lateral side 212 of the base plate 200. In other non-limiting embodiments of the present technology, the apex 220 could be located either closer to the first lateral side 210 of the base plate 200, or closer to the second lateral side 212 of the base plate 200.

In another non-limiting embodiment of the present technology, the first face 202 of the base plate 200 may comprise a single inclined surface (not depicted) extending between the first lateral side 210 and the second lateral side 212 of the base plate 200. It is contemplated that a single inclined surface could be inclined so as to guide water droplets towards the outside of a house or a building.

While the first face 202 illustrated in FIG. 3 has a substantially triangular cross-sectional shape, it is contemplated that in alternative non-limiting embodiments of the present technology, the first face 202 illustrated in FIG. 3 could have a rounded shape.

In one non-limiting embodiment of the present technology, the surface of the first face 202 is smooth to allow moisture to drip away therefrom.

In another non-limiting embodiment of the present technology, the cross-section of the first face 202 of the base plate 200 could be a planar surface, parallel to the receiving surface 110, and extend between the first lateral side 210 and the second lateral side 212 of the base plate 200.

Figure 6:
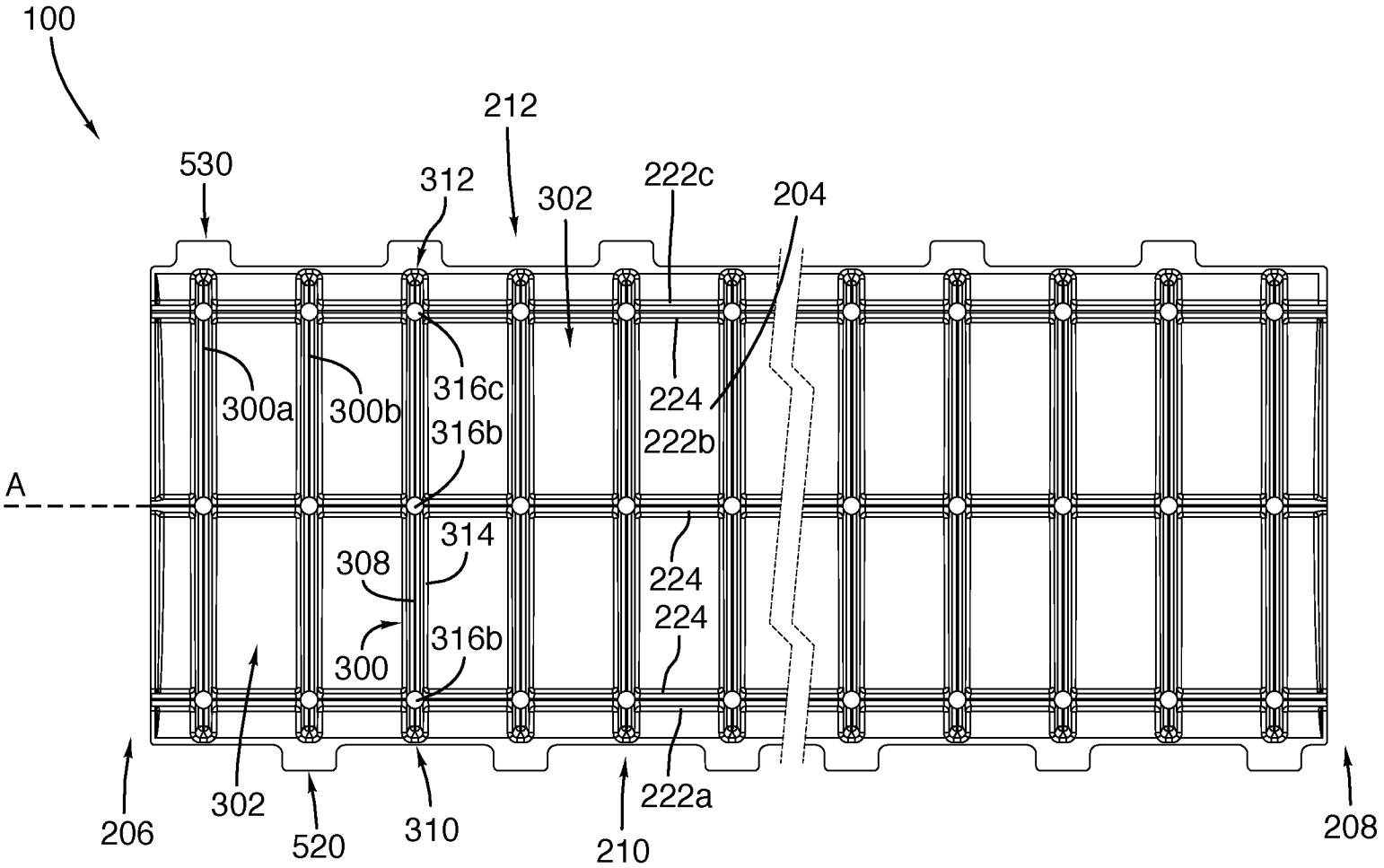
FIG. 6 illustrates a bottom view of the ventilating sill plate of FIG. 1.

With reference to FIGS. 3 and 6, the second face 204 of the base plate 200, from which the plurality of support legs 300 extend, is planar and faces the receiving surface 110.

In this non-limiting embodiment of the present technology, the second face 204 of the base plate 200 comprises a plurality of longitudinal reinforcement members 222*a*, 222*b* and 222*c* for providing an increased resistance to bending and warping of the base plate 200.

The plurality of longitudinal reinforcement members 222*a*, 222*b* and 222*c* are parallel to the longitudinal axis A of the base plate 200 and extend from the first longitudinal end 206 thereof to the second longitudinal end 208 thereof. The plurality of longitudinal reinforcement members 222*a*, 222*b* and 222*c* provide an increased stability to the ventilating sill plate 100 as the wall portion (not depicted) is positioned on the support pads 400.

In the non-limiting embodiment depicted herein, a first reinforcement member 222*a* is located proximate the first lateral side 210 of the base plate 200, a second reinforcement member 222*b* is located at equal distance between the first and second lateral sides 210 and 212 of the base plate 200, and a third reinforcement member 222*c* is located proximate the second lateral side 212 of the base plate 200.

It is contemplated that in other non-limiting embodiments of the present technology, a number and disposition of the reinforcement members may be different. In a first non-limiting example, the second face 204 could comprise a single reinforcement member positioned at equal distance between the first lateral side 210 and the second lateral side 212 of the base plate 200. In another non-limiting example, the second face 204 could comprise more than three reinforcement members, which could be equally spaced between the first lateral side 210 and the second lateral side 212 of the base plate 200 for providing a uniform resistance to bending and warping of the base plate 200.

In the embodiment depicted in FIG. 6, an edge 224 joining the plurality of reinforcement members 222*a*, 222*b* and 222*c* to the second face 204 of the base plate 200 is rounded for enhancing air ventilation between the receiving surface 110 and the second face 204.

In alternative non-limiting embodiment of the present technology, the second face 204 of the base plate 200 may be void of reinforcement members.

In one non-limiting embodiment of the present technology, the first lateral side 210 and the second lateral side 212 of the base plate 200 extend parallel to the longitudinal axis A. In other non-limiting embodiments of the present technology, a distance between the first lateral side 210 and the second lateral side 212 of the base plate 200 could vary from the first longitudinal end 206 to the second longitudinal end 208 for accommodating a size and shape of a wall portion (not depicted). For instance, the distance between the first lateral side 210 and the second lateral side 212 at the first longitudinal end 206 of the base plate 200 may be greater than the distance between the first lateral side 210 and the second lateral side 212 at the second longitudinal end 208 of the base plate 200.

In the non-limiting embodiment illustrated in FIG. 2 and FIG. 3, the first edge 214 and the second edge 216 joining the first face 202 and the second face 204 of the base plate 200 are rounded for enhancing the discharge of water droplets from the first inclined surface 218*a* and the second inclined surface 218*b* and for improving air ventilation.

Support Legs

Figure 4:
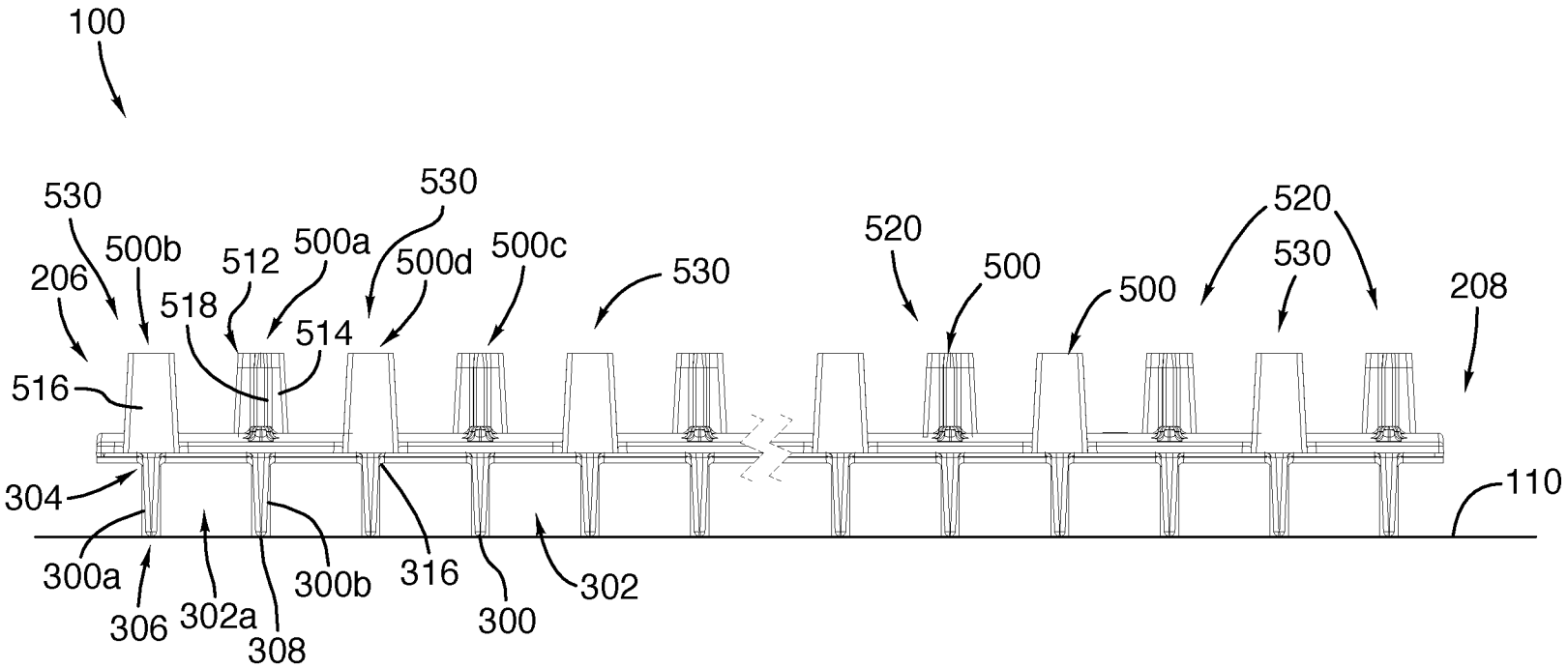
FIG. 4 illustrates an elevated side view of the ventilating sill plate of FIG. 1

With reference to FIGS. 3, 4 and 6, the plurality of support legs 300 will now be described. The plurality of support legs 300 are adapted to elevate the base plate 200 from the receiving surface 110. The plurality of support legs 300 have an elongated shape and extend vertically between a connecting end 304, attached to the second face 204 of the base plate 200, and a contacting end 306, located away from the second face 204. The contacting end 306 of each of the plurality of support legs 300 has a contact surface 308 collaborating to form a plane for abutting the ventilating sill plate 100 on the receiving surface 110. The plurality of support legs 300 further extend laterally, i.e. in a direction perpendicular to the longitudinal axis A of the base plate 200, between a first end 310 located proximate the first lateral side 210 of the base plate 200 and a second opposing end 312 located proximate the second lateral side 212 of the base plate 200. The plurality of support legs 300 are longitudinally spaced along the longitudinal axis A of the base plate 200 so as to form ventilating channels 302 between two consecutive support legs. For instance, a ventilating channel 302*a* is formed between a first support leg 300*a* and a second support leg 300*b*, as shown in FIGS. 4 and 6. The ventilating channels 302 enable air ventilation under the base plate 200 between the first lateral side 210 and the second lateral side 212 thereof for preventing the formation and accumulation of moisture and humidity.

In the embodiment depicted herein, the plurality of support legs 300 are parallel and are in an equally spaced arrangement along the longitudinal axis A of the base plate 200. In alternative non-limiting embodiments of the present technology, the plurality of support legs 300 could be unevenly spaced along the longitudinal axis A of the base plate 200. This could for instance be the case for portions of the ventilating sill plate 100 which need an increased support for supporting parts of the wall portion (not depicted) which may be heavier.

In other non-limiting embodiments of the present technology, the plurality of support legs 300 may extend in an angled direction relative the longitudinal axis A of the base plate 200. Additionally, the plurality of support legs 300 could be angled between each other while still forming ventilating channels 302 to enable air circulation under the base plate 200 between the first lateral side 210 and the second lateral side 212 thereof.

In one non-limiting embodiment of the present technology, the plurality of support legs 300 further have a funneled shape extending from the connecting end 304 to the contacting end 306 for improving circulation of air in the ventilating channels 302. In another non-limiting embodiment, an edge 314 joining the support legs 300 to the second face 204 of the base plate 200 at the connecting end 304 is rounded to further enhance air ventilation under the base plate 200.

Vertical Reinforcement Members

In the non-limiting embodiment depicted in FIG. 3 and FIG. 6, the plurality of support legs 300 have a plurality of vertical reinforcement members 316*a*, 316*b* and 316*c* for providing an increased resistance to warping as well as providing an enhanced stability to the ventilating sill plate 100 as it remains on the receiving surface 110. The plurality of vertical reinforcement members 316*a*, 316*b* and 316*c* extend vertically from the connecting end 304 of the plurality of support legs 300 to the contacting end 306 thereof and are flush with the contact surface 308 of the plurality of support legs 300 for contacting the receiving surface 110.

In some non-limiting embodiment of the present technology, the plurality of vertical reinforcement members 316*a*, 316*b* and 316*c* are equally spaced along the plurality of support legs 300 between the first end 310 and the second end 312 thereof. In this non-limiting embodiment, the plurality of vertical reinforcement members 316*a*, 316*b* and 316*c* may for instance intersect with the plurality of longitudinal reinforcement members 222*a*, 222*b* and 222*c* at the connecting end 304. For instance and with reference to FIG. 3, a first vertical reinforcement member 316*a* may intersect with the first longitudinal reinforcement member 222*a* proximate to the first lateral side 210 of the base plate 200, a second vertical reinforcement member 316*b* may intersect with the reinforcement member 222*b* at a position located at equal distance between the first and second lateral sides 210 and 212 of the base plate 200, and a third vertical reinforcement member 316*c* may intersect with the reinforcement member 222*c* proximate the second lateral side 212 of the base plate 200. In this case and as depicted in FIG. 3, each of the plurality of vertical reinforcement members 316*a*, 316*b* and 316*c* comprise a respective partially circular attachment 318 adapted to join with their respective members in plurality of longitudinal reinforcement members 222*a*, 222*b* and 222*c*.

In alternative non-limiting embodiments of the present technology, each support leg 300 could comprise a single vertical reinforcement member, or more than three vertical reinforcement members (not depicted). Further, the reinforcement portions could be unevenly spaced along support leg 300 between the first end 310 and the second end 312 thereof.

Support Pads

Figure 5:
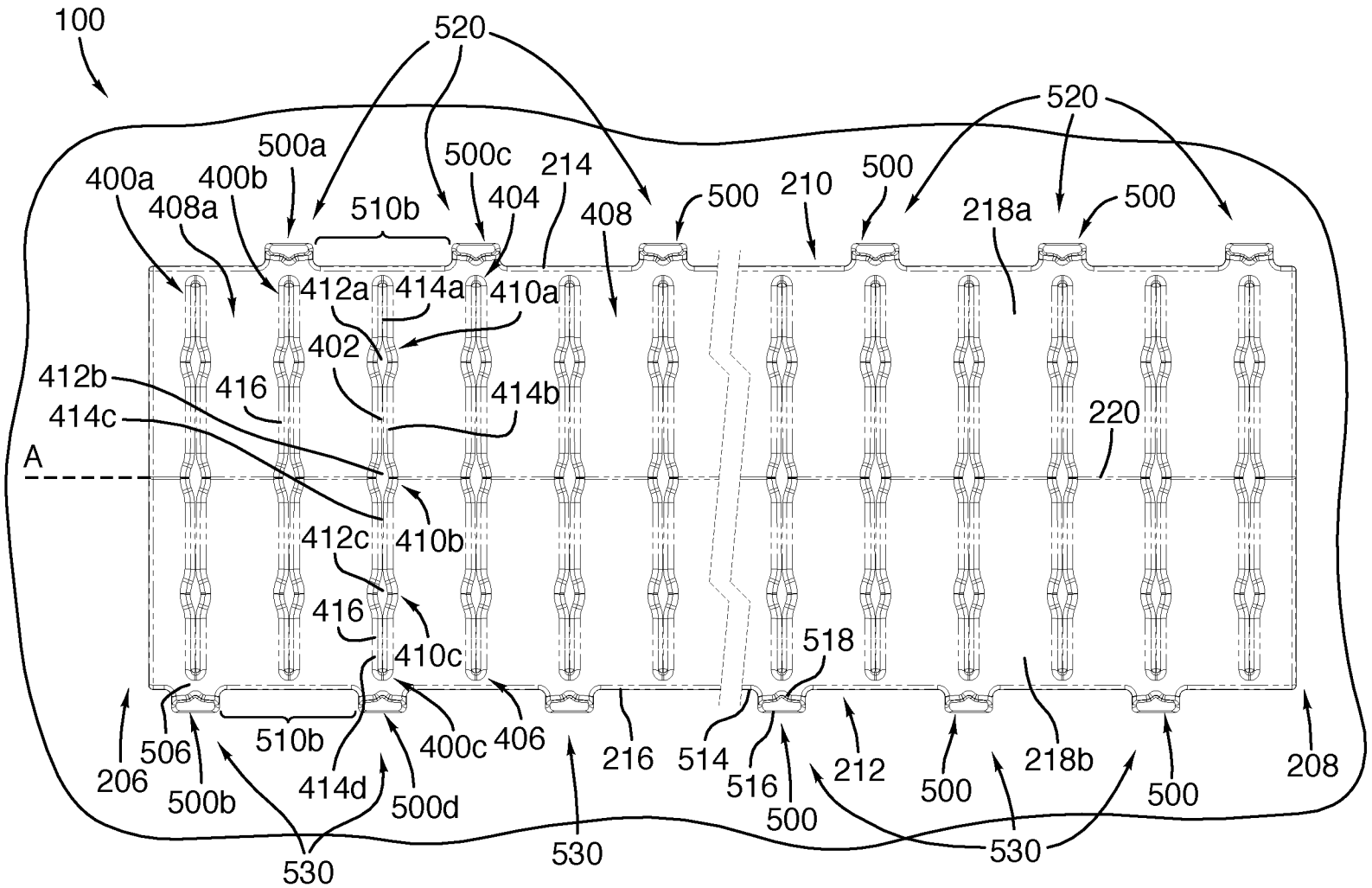
FIG. 5 illustrates a top view of the ventilating sill plate of FIG. 1.

With reference to FIGS. 2, 3 and 5, the support pads 400 will now be described in more detail. The support pads 400 have a generally elongated narrow body projecting vertically from the first inclined surface 218*a* and the second inclined surface 218*b* of the base plate 200, in a direction away from the receiving surface 110, and comprise a support surface 402 adapted to be in contact with and elevate the wall portion (not depicted). The support surface 402 of each support pad 400 collaborate to define a plane for elevating the wall portion from the first face 202 of the base plate 200, as it is positioned thereon. In some non-limiting embodiment of the present technology, the plane formed by the support surface 402 of the support pads 400 is parallel to the plane formed by the contact surface 308 of the plurality of support legs 300. The support pads 400 further extend along a plane perpendicular to the longitudinal axis A, between a first end 404 located proximate the first lateral side 210 of the base plate 200 and a second opposing end 406 located proximate the second lateral side 212 of the base plate 200. The support pads 400 are further parallel between each other and longitudinally spaced along the longitudinal axis A of the base plate 200, between the first longitudinal end 206 and the second longitudinal end 208 thereof. In this case, the support pads 400 define a plurality of parallel draining channels 408 for draining water droplets and enhancing air ventilation between the base plate 200 and the wall portion. For instance, as shown in FIG. 5, a draining channel 408*a* is formed between a first support pad 400*a* and a second support pad 400*b* of the support pads 400.

In the non-limiting embodiment depicted in FIGS. 2 and 5, the support pads 400 comprise reinforcement sections 410*a*, 410*b* and 410*c* located between the first end 404 and the second end 406 thereof and adapted to provide an increased stiffness to the ventilating sill plate 100. In this non-limiting embodiment, the reinforcement sections 410*a*, 410*b* and 410*c* have a generally oval shape comprising increased support surfaces 412*a*, 412*b* and 412*c*, lined up with the support surface 402, and located between narrow body portions 414*a*, 414*b*, 414*c* and 414*d* of the support pads 400.

In one non-limiting embodiment of the present technology, the reinforcement sections 410*a*, 410*b* and 410*c* are designed to minimize contact between the wall portion (not depicted) and the support surface 402 to improve air ventilation and drying of the wall portion while still providing an increased stiffness to the ventilating sill plate 100. In a further non-limiting embodiment, the edge 416 joining the first face 202 of the base plate 200 to the support pads 400 is rounded for further improving the drainage of water droplets and the ventilation of air between the base plate 200 and the wall portion.

In the embodiment depicted herein, the reinforcement sections 410*a*, 410*b* and 410*c* are equally spaced along the support pads 400, where the reinforcement section 410*a* is located on the first inclined surface 218*a*, between narrow body portions 414*a* and 414*b*. The reinforcement section 410*b* is further located at equal distance between the first and second lateral sides 210 and 212 of the base plate 200, between narrow body portions 414*b* and 414*c*. The reinforcement section 410*c* is further located on the second inclined surface 218*b*, between narrow body portions 414*c* and 414*d*.

In one non-limiting embodiment of the present technology, the support pads 400 are aligned with the plurality of support legs 300 in a plane perpendicular to the longitudinal axis A of the base plate 200 for providing an increased resistance to bending and warping to the ventilating sill plate 100. Further, it is contemplated that the reinforcement sections 410*a*, 410*b* and 410*c* of the support pads 400 could also be aligned with the plurality of vertical reinforcement members 316*a*, 316*b* and 316*c* of the plurality of support legs 300 for further increasing the stiffness of the ventilating sill plate 100 for supporting the wall portion.

In another non-limiting embodiment of the present technology, the reinforcement sections 410*a*, 410*b* and 410*c* could be unevenly spaced along the support pads 400. Further, it is contemplated that a number of reinforcement sections could vary. For instance, in one case, the support pads 400 could only comprise two reinforcement sections 410*a* and 410*c* located on each of the first inclined surface 218*a* and the second inclined surface 218*b* of the base plate 200 while in a second case, the support pads 400 could comprise more than three reinforcement sections. In another non-limiting embodiment, the number of reinforcement sections on each support pad may be different.

In another non-limiting embodiment of the present technology, the reinforcement sections 410*a*, 410*b* and 410*c* could have a different shape such as a square or a circular shape while still providing an increased stiffness to the ventilating sill plate 100.

In another non-limiting embodiment, the support pads 400 could be void of the narrow body portions and only comprise the reinforcement sections for improving the air ventilation between the wall portion and the base plate 200.

Although the support pads 400 extend in a direction perpendicular to the longitudinal axis A, between the first lateral side 210 and the second lateral side 212 of the base plate 200, it is contemplated that in another non-limiting embodiment, the support pads 400 could extend in an angled direction relative the longitudinal axis A, between the first lateral side 210 and the second lateral side 212 of the base plate 200.

In other non-limiting embodiments, consecutive support pads of the support pads 400 may not be parallel between the first end 404 and the second end 406 thereof. For instance, a distance at the first end 404 between the first support pad 400*a* and the second support pad 400*b* may be greater than the distance at the second end 406 therebetween.

Further, in this non-limiting embodiment, the distance at the second end 406 between support pads 400*b* and 400*c* may be greater than the distance at the first end 404 therebetween. The person skilled in the art will appreciate that other configurations are possible.

In another non-limiting embodiment, the support pads 400 could be unevenly spaced along the longitudinal axis A of the base plate 200 while still forming draining channels 408 for draining water droplets and enable air ventilation.

In another non-limiting embodiment, the support pads 400 could be in a staggered pattern arrangement. For instance, in this embodiment, the first support pad 400*a* could extend between the first lateral side 210 of the base plate 200 and the apex 220 thereof, while the second support pad 400*b* could extend between the second lateral side 212 of the base plate 200 and the apex 220 thereof. Successive support pads 400 would therefore follow this pattern along the longitudinal axis A between the first longitudinal end 206 and the second longitudinal end 208 of the base plate 200.

Arms

With reference to FIGS. 2 to 5, the plurality of arms 500 will now be described. The arms 500 are in a longitudinally spaced arrangement and define a first set of arms 520 extending from the first lateral side 210 of the base plate 200 and a second set of arms 530 arms extending from the second lateral side 212 of the base plate 200. The distance separating the first and second set of arms 520, 530 is adapted to guide and maintain the wall portion as it is positioned on the support pads 400.

In the non-limiting embodiment of the present technology depicted in FIG. 3, the arms 500 are generally L-shaped and comprise a first portion 502 projecting outwardly from the base plate 200 in a plane substantially parallel to the second face 204 thereof, and a second portion 504, substantially orthogonal to the first portion 502, and extending vertically in a direction away, from the first face 202.

In some non-limiting embodiments of the present technology, the first portion 502 of the first set of arms 520 extends outwardly from the first lateral side 210 of the base plate 200 while the first portion 502 of the second set of arms 530 extends outwardly from the second lateral side 212 of the base plate 200.

In one non-limiting embodiment of the present technology, shown in FIG. 3, the first portion 502 of the arms 500 has an upper surface 506 coplanar with the first face 202 of the base plate 200 and a lower surface 508 coplanar with the second face 204 of the base plate 200. The first portion 502 of the arms 500 further projects in a direction parallel to the longitudinal axis. In this non-limiting embodiment and with reference to FIG. 5, two consecutive arms 500 define recesses 510 extending therebetween. For instance, a first arm 500*a* and a second arm 500*c* of the first set of arms 520 define a first recess 510*a* extending between the first portions 502 thereof at the first lateral side 210 of the base plate 200. In a similar manner, consecutive arms, for instance arms second arm 500*b* and third arm 500*d* of the second set of arms 530 define a second recess 510*b* extending between the first portions 502 thereof at the second lateral side 212 of the base plate 200. In this non-limiting embodiment, the first recess 510*a* and the second recess 510*b* improve the water drainage from the first inclined surface 218*a* and the second inclined surface 218*b*, respectively.

Referring back to FIGS. 2 to 5, the second portion 504 of the arms 500 has a generally rectangular shape, extending orthogonally from the first portion 502 to an upper end 512. The second portion 504 comprises a pressure surface 514 facing the base plate 200 and an outer surface 516 opposite the pressure surface 514 and extending away from the base plate 200. It is contemplated that the second portion 504 of the plurality of arms 500 could extend vertically at an angle from the first portion 502 instead of being orthogonal to the first portion 502.

In the depicted embodiment, a generally partially rounded pressure rib 518 protrudes from the pressure surface 514 towards the base plate 200 along a plane perpendicular to the longitudinal axis A thereof. The pressure rib 518 extends between the upper surface 506 and the upper end 512 of the arms 500 and is adapted to contact the wall portion as it is positioned between the first and second set of arms 520, 530 on the support pads 400. In one non-limiting embodiment of the present technology, the pressure rib 518 is configured to create a force as the wall portion is positioned on the support pads 400. More precisely, the distance between the pressure ribs 518 of the first and second set of arms is such that it generates a squeezing force which tightly maintains the wall portion on the support pads 400, between the first and second set of arms.

In one non-limiting embodiment depicted in FIGS. 2 and 3, an edge 515 joining the upper surface 506 of the first portion 502 to the pressure surface 514 of the second portion 504 of the arms 500 is flexible and enables the arms 500 to bend away from the base plate 200. More precisely, the second portion 504 of the arms 500 is adapted to bend along a plane perpendicular to the longitudinal axis A of the base plate 200. In a further non-limiting embodiment, as shown in FIG. 3, the arms 500 comprise an inclined upper portion 522, oriented towards the base plate 200 to guide the wall portion (not depicted) on the support pads 400 as the wall portion is positioned thereon. In this non-limiting embodiment, the flexibility of the arms 500 and the inclined upper portion 522 collaborate to facilitate the positioning of the wall portion on the support pads 400. This is for instance the case wherein the wall portion is misaligned with the base plate 200. Therefore, as the wall portion contacts the inclined upper portion 522 of the arms 500, the arms 500 may bend for guiding the wall portion towards the base plate 200 and therefore enabling a realignment thereon.

In one non-limiting embodiment of the present technology, the edge 515 is rounded to reinforce the arms 500 during bending. In a further embodiment, the edge 515 is rounded to improve the drainage of water as it is guided on the first inclined surface 218*a* and the second inclined surface 218*b* towards the first lateral side 210 and the second lateral side 212 of the base plate 200.

In one non-limiting embodiment of the present technology, the first and second set of arms 520, 530 are in a staggered arrangement along the longitudinal axis A on the first and second lateral sides 210, 212 of the base plate 200, as shown in FIG. 5. Further, each arm of the first and second set of arms 520, 530 may be aligned with a corresponding support pad 400 for increasing the stiffness of the ventilating sill plate 100.

In an alternative non-limiting embodiment, the arms 500 could be positioned differently along the first and second lateral sides 210 and 212 of the base plate 200. For instance, in a first case, the arms 500 of the first and second set of arms may be in a staggered arrangement with the support pads 400. In a second case, the arms 500 of the first and second set of arms could face each other.

In another non-limiting embodiment, the arms 500 may have a different configuration. For instance, the arms 500 could have more than one pressure rib for contacting the wall portion. In a further non-limiting embodiment, the arms 500 may be void of the first portion 502 and may therefore extend from the first face 202 in a direction perpendicular to the second face 204 of the base plate 200, away from the receiving surface 110. In this non-limiting embodiment, the outer surface 516 of the second portion 504 of the first and second set of arms 500 is flush with first and second lateral sides 210 and 212 of the base plate 200, respectively.

In one non-limiting embodiment of the present technology, the ventilating sill plate 100 is made from plastic. Alternatively, the ventilating sill plate 100 could be made from one or more other materials such as stainless steel, fiberglass, aluminum, resin material, and the like. In one non-limiting embodiment of the present technology, the ventilating sill plate 100 could be molded to comprise a single piece. In another non-limiting embodiment, the ventilating sill plate 100 could be machined or 3D printed.

Although in the illustrated embodiment the ventilating sill plate 100 extends along the longitudinal axis A, it should be understood that the ventilating sill plate 100 could be curved for supporting a curved wall portion. As a non-limiting example, the ventilating sill plate 100 could be trimmed and cut to fit a curved wall.

In one non-limiting embodiment of the present technology, the distance between the first longitudinal end 206 and the second longitudinal end 208 of the base plate 200 is 48 inches (about 122 cm). It is contemplated that other distances, less or greater than 48 inches, may be considered for accommodating a plurality of walls having different sizes.

In one non-limiting embodiment of the present technology, the distance between the first lateral side 210 and the second lateral side 212 of the base plate 200 is either 1.5 inches (about 3.8 cm), 2.5 inches (about 6.35 cm), 3.5 inches (about 8.9 cm) or 5.5 inches (about 13.98 cm). It is contemplated that the distance between the first lateral side 210 and the second lateral side 212 of the base plate 200 could be different for accommodating wall portions having different sizes.

In one non-limiting embodiment of the present technology, the distance between the connecting end 304 and the contacting end 306 of the plurality of support legs 300 is 0.5 inches (about 1.27 cm) and the distance between two consecutive support legs, for instance the first support leg 300*a* and the second support leg 300*b* is 0.75 inches (about 1.905 cm). The person skilled in the art will appreciate that other dimensions may be considered.

In one non-limiting embodiment of the present technology, two consecutive support pads, such as the first support pad 400*a* and the second support pad 400*b*, are longitudinally spaced from one another by 0.75 inches (about 1.9 cm). It is contemplated that that the longitudinal distance separating two consecutive support pads could be either be greater or smaller than 0.75 inches, while still forming draining channels for draining water and vent air.

Although not shown, in an alternative non-limiting embodiment, a plurality of successive ventilating sill plates may be longitudinally connected to each other.

Second Embodiment

Figure 7:
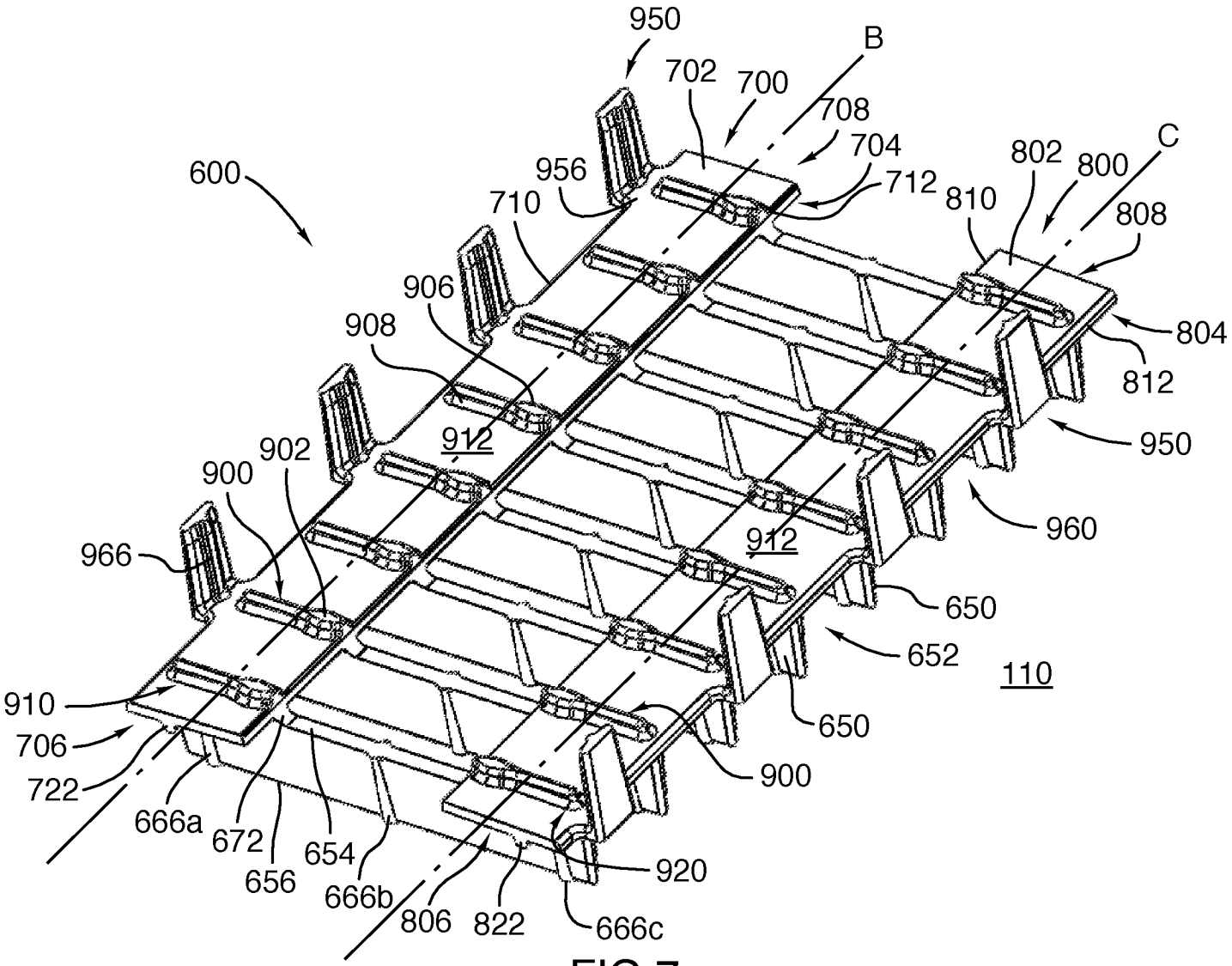
FIG. 7 illustrates a top perspective view of a ventilating sill plate in accordance with another embodiment of the present technology.
Figure 8:
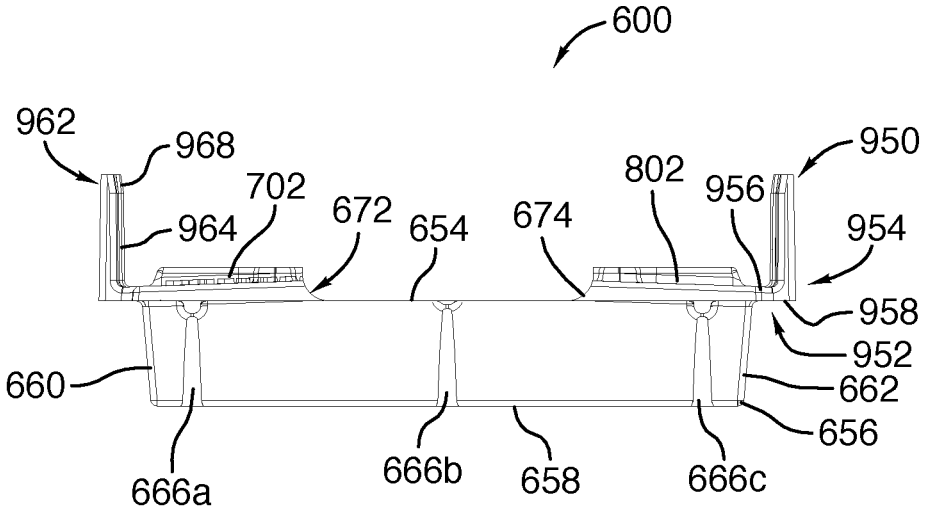
FIG. 8 illustrates an elevated front view of the ventilating sill plate of FIG. 7 in accordance with a non-limiting embodiment of the present technology.
Figure 9:
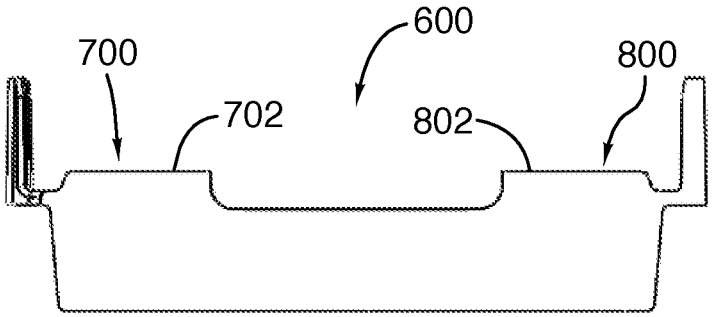
FIG. 9 illustrates an elevated front view of the ventilating sill plate of FIG. 7.

With reference to FIG. 7 to FIG. 9, there is depicted another non-limiting embodiment of a ventilating sill plate 600.

The ventilating sill plate 600 has a first longitudinal base 700 and a second longitudinal base 800 operatively mounted side by side in a spaced apart relationship. The first longitudinal base 700 has a first face 702, and a second face 704 opposing the first face 702, each extending along a longitudinal axis B between a first longitudinal end 706, and a second longitudinal end 708. The first longitudinal base 700 extends laterally in a direction perpendicular to the longitudinal axis B between a first lateral side 710 and a second lateral side 712. The second longitudinal base 800 has a first face 802, and a second face 804 opposing the first face 802, each extending along a longitudinal axis C between a first longitudinal end 806, and a second longitudinal end 808. The second longitudinal base 800 extends laterally in a direction perpendicular to the longitudinal axis C between a first lateral side 810 and a second lateral side 812. It could be said that the second lateral side 712 of the first longitudinal base 700, and the first lateral side 810 of the second longitudinal base 800 are inward lateral sides of the ventilating sill plate 600. It could be said that the first lateral side 710 of the first longitudinal base 700 and the second lateral side 812 of the second longitudinal base 800 are outward lateral sides of the ventilating sill plate 600.

Longitudinal Reinforcement Members

In the embodiment illustrated herein, the first longitudinal base 700 has a longitudinal reinforcement member 722, and the second longitudinal base 800 has a longitudinal reinforcement member 822 respectively extending therealong and on the second faces 704, 804 for providing an increased resistance to bending and warping of each of the first longitudinal base 700 and the second longitudinal base 800

In some non-limiting embodiments of the present technology, additional reinforcement members (not depicted) could be provided longitudinally or breadthwise to increase even more stiffness of the first longitudinal base 700 and the second longitudinal base 800, and provide an increased stability to the ventilating sill plate 600 as the wall portion is positioned thereon.

Support Legs

The ventilating sill plate 600 also has a plurality of support legs 650 adapted to elevate the ventilating sill plate 600 from the receiving surface 110.

Similarly to the support legs 300, the plurality of support legs 650 have an elongated shape and extend between a connecting end 654, for receiving the second faces 704, 804 of each of the first longitudinal base 700 and the second longitudinal base 800, and a contacting end 656, located away from the second faces 704, 804. The contacting end 656 of the support legs 650 comprises a contact surface 658 (FIG. 8) collaborating to form a plane for abutting the receiving surface 110 on which the ventilating sill plate 600 is positioned. The plurality of support legs 650 further extend in a direction perpendicular to the longitudinal axes B, C of the ventilating sill plate 600 between a first end 660 located proximate the first lateral side 210 of the first longitudinal base 700 and a second opposing end 662 located proximate the second lateral side 812 of the second longitudinal base 800.

Two adjacent support legs of the plurality of support legs 650 define a ventilating channel 652 therebetween. In the embodiment illustrated herein, the plurality of support legs 650 has 8 support legs defining 7 ventilating channels 652. Thus, when a wall portion is mounted on the ventilating sill plate 600, the ventilating channels 652 enables air circulation from one side of the wall portion to the other, to thereby prevent accumulation of moisture and humidity.

In the embodiment illustrated herein, the plurality of support legs 650 are parallel and are in an equally spaced arrangement along the first longitudinal base 700 and the second longitudinal base 800, and are perpendicular thereto to define similar parallel ventilating channels along the ventilating sill plate 600, however this does not need to be so in every embodiment of the present technology, and various arrangements for the support legs can be considered. As a non-limiting example, the plurality of support legs 650 could be unevenly spaced along the longitudinal axes B, C. Additionally or alternatively, the plurality of support legs 650 could be mounted at an angle relative to the first longitudinal base 700 and the second longitudinal base 800, either for defining ventilating channels parallel to each other, either for defining parallelepiped shaped ventilating channels.

Connecting Portions

In one non-limiting embodiment, each of the plurality of support legs 650 has a first connecting portion 672 and a second connecting portion 674, projecting from the connecting end 654, and proximate the second lateral side 712 of the first longitudinal base 700, and the first lateral side 810 of the second longitudinal base 800 respectively. In one non-limiting embodiment, the first connecting portion 672 and the second connecting portion 674, have a concave rounded shape and define a continuous surface between the second lateral side 712 of the first longitudinal base 700, and the first lateral side 810 of the second longitudinal base 800 respectively, and the connecting end 654 of the support leg, thereby facilitate drainage of water thereon.

In another non-limiting embodiment, the support legs are not provided with the first connecting portion 672 and the second connecting portion 674. Rather, the first connecting portion 672 and the second connecting portion 674, are provided on the second lateral side 712 of the first longitudinal base 700, and the first lateral side 810 of the second longitudinal base 800 respectively, and project therefrom towards of the plurality of support legs 650. In this case, the first connecting portion 672 and the second connecting portion 674 are spaced along the second lateral side 712 of the first longitudinal base 700, and the first lateral side 810 of the second longitudinal base 800 respectively so as to be aligned with the support legs 650. In one non-limiting embodiment, each of the first connecting portion 672 and the second connecting portion 674, has a concave rounded shape and defines a continuous surface between the corresponding inward sides 712, 810 of the first longitudinal base 700, and the second longitudinal base 800, and a top face of the support leg 650, to thereby facilitate drainage of water thereon.

In one non-limiting embodiment, as better shown in FIG. 7, each of the first faces 702, 802 of the first longitudinal base 700 and the second longitudinal base 800, is slightly inclined along the respective longitudinal axes B, C towards the second lateral side 712 and the second lateral side 812 respectively, extending outwards. This arrangement enables enhanced drainage of water which may accumulate under the wall portion. More particularly, the pair of inclined surfaces provided by the first faces 702, 802 of the first longitudinal base 700 and the second longitudinal base 800, prevents the retention of water under the wall portion and enables the water droplets, falling thereon, to be guided by gravity towards the lateral sides and extending outwardly and be discharged therefrom, as it will become apparent below.

In a further embodiment, the surface of the first faces 702, 802 is smooth enough to allow moisture to drip away.

In one non-limiting embodiment, each of the first longitudinal base 700, and the second longitudinal base 800, has a plate of rectangular cross section mounted with the first connecting portion 672 and the second connecting portion 674, provided the second lateral side 712 of the first longitudinal base 700 and the first lateral side 812 of the second longitudinal base 800, or on the top face of the support legs 650, as detailed above. In this case, the first connecting portion 672 and the second connecting portion 674, are designed to respectively raise the second lateral side 712 of the first longitudinal base 700 and the first lateral side 812 of the second longitudinal base 800 relatively to the first lateral side 710 and the second lateral side 812 thereof. Alternatively, a portion of the top face of the support legs 650 extending below the first longitudinal base 700 and the second longitudinal base 800 can be slightly inclined to the outwards. In another embodiment, each of the first longitudinal base 700, and the second longitudinal base 800, has a plate of triangular cross section mounted directly on the top flat faces of the support legs 650.

Figure 10:
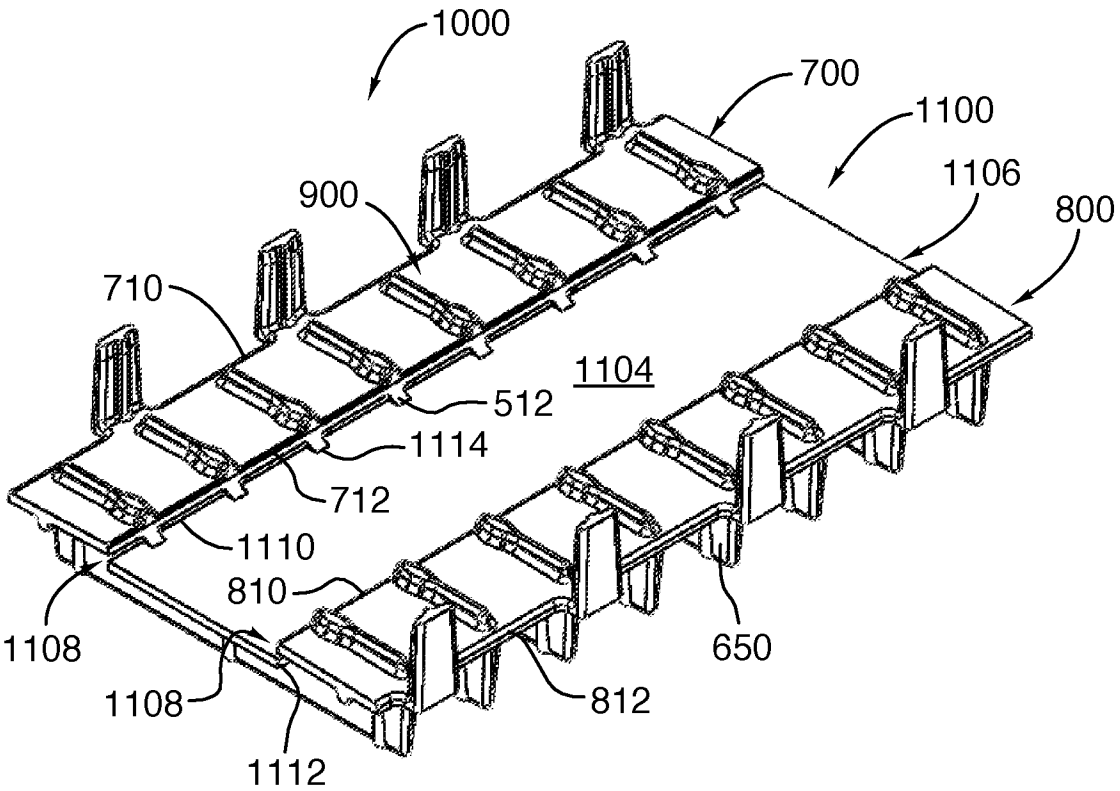
FIG. 10 illustrates a top perspective view of a ventilating sill plate in accordance with another embodiment of the present technology.

As shown in FIG. 10 and according to another embodiment, the first faces 702, 802 of the first longitudinal base 700, and the second longitudinal base 800, may also extend parallel to the receiving surface without any inclination.

In one non-limiting embodiment, the first lateral side 710 of the first longitudinal base 700 and the second lateral side 812 of the second longitudinal base 800 each have a rounded edge to further enhance the discharge of water droplets therefrom.

In another non-limiting embodiment, each of the first faces 702, 802 of the first longitudinal base 700 and the second longitudinal base 800 is slightly inclined along the longitudinal axis of the corresponding longitudinal base 700, 800 towards the second lateral side 712, and the first lateral side 812 thereof extending inwards. This arrangement enables evacuation of water from the wall portion below the wall portion and into the ventilating channels 652. Air circulation in the ventilating channels 652 will help elimination of water droplets that may accumulate therein. In another non-limiting embodiment, one of the first faces 702, 802 is slightly inclined along the longitudinal axis of the corresponding longitudinal base 700, 800 towards a corresponding lateral side 712, 810 thereof extending inwards, while the other face 702, 802 is slightly inclined towards a corresponding lateral side 710, 812 extending outwards.

In the non-limiting embodiment illustrated herein, the first longitudinal base 700 and the second longitudinal base 800 are identical but other arrangements may be considered for a specific application. Moreover, although the illustrated first faces 702, 802, of the first longitudinal base 700 and the second longitudinal base 800, have a planar surface, rounded surfaces may also be considered, as it should become apparent to the skilled addressee.

In the embodiments illustrated in FIG. 8 and FIG. 9, the bottom face of each of the support legs is flat and extends against the receiving surface all along to enhance support of the wall portion and provide enhanced stiffness to the ventilating sill plate 1000.

Vertical Reinforcement Members

In the embodiment illustrated in FIG. 8, the plurality of support legs 650 are provided with vertical reinforcement members 666*a*, 666*b*, and 666*c* (three depicted in the illustrated embodiment) distributed therealong to further improve resistance of the ventilating sill plate 600 to warping, and providing enhanced stability to prevent any bending of the plurality of support legs 650 when a wall portion is mounted thereon.

In the illustrated non-limiting embodiment, the plurality of support legs 650 are equally spaced along the first longitudinal base 700 and the second longitudinal base 800. In another non-limiting embodiment, the support legs may alternatively be unevenly spaced and closer to each other on portions of the ventilating sill plate that require an increase support for supporting portions of the wall which may be heavier.

Support Pads

Referring again to FIG. 7 and FIG. 8, the ventilating sill plate 600 has a plurality of support pads 900, the plurality of support pads 900 including a first set of support pads 910 and a second set of support pads 920. The first set of support pads 910 projects from the first face 702 of the first longitudinal base 700, and the second set of support pads 920 projects from the first face 802 of the second longitudinal base 800. Each of the plurality of support pads 900 has a support surface 902 adapted for supporting the wall portion thereon. A combination of each support surface 902 of the plurality of support pads 900 collaborate to define a plane enabling to support the wall portion thereon in an elevated manner with respect to the first longitudinal base 700, and second longitudinal bases 800. In other words, the bottom of the wall portion does not directly contact the longitudinal bases 700, 800, as better shown in FIG. 11 detailed below. This arrangement enables enhanced elimination of water or moisture that may have accumulated in the wall portion and enhanced air ventilation between the longitudinal bases 700, 800 and the wall portion. In one non-limiting embodiment, the elevated support pads 900 are provided with several support surfaces 902 for improving support of the wall portion thereon.

In the non-limiting embodiment illustrated herein, the support pads 900 have an elongated shape and extend perpendicularly across the width of the corresponding base 700, 800. As it can be seen, two adjacent support pads 900 define a drainage channel 912 from the second lateral side 712 of the first longitudinal base 700, and the first lateral side 812 of the second longitudinal base 800 (i.e. inwards side of the ventilating sill plate 600) to the first lateral side 710 of the first longitudinal base 700 and the second lateral side 812 of the second longitudinal base 800 (i.e. outwards side of the second longitudinal base 800). Such drainage channels 912 help to guide any water droplets therealong towards the corresponding lateral side.

In one non-limiting embodiment, as illustrated, the support pads 900 are equally spaced on the corresponding longitudinal base 700, 800 and define identical parallel drainage channels 912 thereon. In a further embodiment, the support pads 900 on one of the longitudinal bases 700, 800 extend in alignment with the support pads 900 of the other longitudinal base 700, 800 and are also in alignment with the corresponding support legs 650. Other arrangements may be considered. As a non-limiting example, the first set of support pads 910 and the second set of support pads 920 may extend in a staggered arrangement.

In the non-limiting embodiment illustrated in FIG. 7, each of the support pads 900 has a first portion 906 of enlarged width proximate the corresponding inwards side 712, 810 of the corresponding longitudinal base 700, 800 which provides the support surface 902 and a second elongated portion 908 of thinner width extending up to the corresponding outwards side 710, 812 of the corresponding longitudinal base 700, 800. In the case the longitudinal bases 700, 800 are inclined outwardly, as detailed above, the wall portion will mainly rest on the support surface 902 of the first portion 906 of enlarged width of the support pads 900. The second elongated portions 908 of thinner width are designed to minimize the contact between the wall portion and the support pads 900 to improve air ventilation and drying of the wall portion while still providing an increased stiffness to the ventilating sill plate 600. In a further embodiment, the edges joining the support pads 900 to the corresponding face 702, 802 of the longitudinal bases 700, 800 are rounded for further improving the drainage of water droplets and the ventilation of air between the longitudinal bases 700, 800 and the wall portion.

In one non-limiting embodiment, the support pads 900 are made of flexible material that is rigid enough to ensure that the wall portion does not contact the longitudinal bases 700, 800.

Plurality of Arms

Still referring to FIG. 7 and FIG. 8, The ventilating sill plate 600 is also provided with a plurality of arms 950. A first set of arms 970 protrudes from the first face 702 at the corresponding lateral side 310 of the first longitudinal base 700 projecting outwards while a second set of arms 980 protrudes from the first face 802 at the corresponding lateral side 410 of the second longitudinal base 800 projecting outwards. As better shown in FIG. 11 and described hereinbelow, a distance between the first set of arms 970 and the second set of arms 980 is adapted to guide the wall portion when it is mounted on ventilating sill plate 600.

In one non-limiting embodiment, the arms 950 have a generally L-shape comprising a first portion 952 extending outwardly from the corresponding longitudinal base 700, 800 in a plane substantially parallel to the receiving surface 110 and a second portion 954, perpendicular to the first portion 952, and extending in a direction away from the receiving surface 110. In the case where the first faces 702, 802 of the longitudinal bases 700, 800 extend in a horizontal plane, i.e. they are not inclined relatively to the receiving surface 110, the first portion 952 of the arm 950 extends in the same plane than the corresponding longitudinal bases 700, 800. In other words, the first portion 952 of the arm 950 comprises an upper surface 956 coplanar with the first face 702, 802 of the corresponding longitudinal base 700, 800 and a lower surface 958 coplanar with the corresponding second face 704, 804 of the longitudinal base 700, 800. As illustrated, two adjacent arms 950 of the corresponding set of arms 950 define a recess 960 extending between the first portions 952 of the corresponding arms 950 at the corresponding side 710, 812 of the corresponding longitudinal base 700, 800. Such embodiment improves water drainage from the corresponding first face 702, 802 of the corresponding longitudinal base 700, 800.

In one non-limiting embodiment, the second portion 954 of the arm 950 has a generally rectangular shape extending to an upper end 962, and comprises a pressure surface 964 proximate the upper end 962 and facing the longitudinal bases 700, 800. In a further embodiment, the pressure surface 964 is provided with pressure ribs 966 protruding towards the longitudinal bases 700, 800 and adapted to contact the wall portion mounted between the two sets of arms 950. In one non-limiting embodiment, the pressure ribs 966 of the arms 950 are adapted to press on the wall portion mounted on the ventilating sill plate 1000. In other words, the two sets of arms 950 in combination provide a squeezing force which tightly hold the wall portion therebetween.

In one non-limiting embodiment, the arms 950 are made flexible to be able to bend outwardly of the ventilating sill plate 1000 to facilitate insertion of the wall portion between the two sets of arms 950. In a further embodiment, the upper end 962 of each of the arms 950 has an inclined upper surface 968 oriented towards the longitudinal bases 700, 800 to guide the wall portion during its mounting.

In the illustrated embodiment, the first set of arms 970 and the second set the arms 980 extend in a staggered arrangement along their corresponding longitudinal base 700, 800 but it is contemplated that the first set of arms 970 of can be facing the second set of arms 980. Other arrangements may also be considered.

In another non-limiting embodiment, the first portion 952 of the arms 950 may be omitted and the second portion 952 thereof is flush with the outward sides 710, 812 of the corresponding longitudinal base 700, 800.

Third Embodiment

Referring now to FIG. 10, there is shown another ventilating sill plate 1000, according to another non-limiting embodiment of the present technology. As it will become apparent below, such embodiment provides a greater versatility to the ventilating sill plate 1000. The illustrated ventilating sill plate 1000 is substantially similar to the ventilating sill plate 600 shown in FIG. 7 to FIG. 9 and is further provided with a central longitudinal base 1100 longitudinally mounted between the first longitudinal base 700, and second longitudinal bases 800. In the non-limiting embodiment illustrated herein, the central longitudinal base 1100 is a planar plate inserted between the first longitudinal base 700, and second longitudinal bases 800 and lying on the top face of each of the support legs 650. As illustrated, once mounted, the central longitudinal base 1100 has a first face 1102 defining a recessed portion 1106 between the first faces 702, 802 of the first longitudinal base 700, and second longitudinal base 800. In the non-limiting embodiment illustrated herein, the central longitudinal base 1100 defines empty spaces 1108 between the first side 1110 and the second lateral side 712 of the first longitudinal base 700, between the second side 1112 and the first lateral side 812 of the second longitudinal bases 800 to prevent any accumulation of water or moisture on the central longitudinal base 1100. Indeed, any water or moisture present on the central longitudinal base 1100 will be allowed to evacuate through these empty spaces 1108. In one non-limiting embodiment, the first side 1110 and the second side 1112 of the central longitudinal base 1100 are provided with rounded edges for enhancing water evacuation.

In one non-limiting embodiment, the central longitudinal base 1100 is planar and is provided with a plurality of notches 1114 longitudinally distributed along the first side 1110 and the second side 1112 of the central longitudinal base 1100 and adapted to collaborate with the first connecting portion 672 and the second connecting portion 6774 (either mounted on the support legs 650 or on the second lateral side 712 of the first longitudinal base 700, and first lateral side 812 of the second longitudinal bases 800) to retain the central longitudinal base 1100 in position and prevent any undesired sliding movement thereof. Such arrangement enables to provide a fast and easy mounting of the central longitudinal base 1100 between the first longitudinal base 700, and second longitudinal bases 800. The central longitudinal base 1100 can also be easily removed according to a specific application.

Now referring back to the ventilating sill plate 100 of FIGS. 1 to 6, we shall describe how the ventilating sill plate 100 is used. It is contemplated that the ventilating sill plate 600, and the ventilating sill plate 100 are used in a similar manner.

In Use

In use, the ventilating sill plate 100 is first positioned on the receiving surface 110. The wall portion is then vertically aligned and lowered onto the support pads 400. As the wall portion is lowered, the lower end thereof may come into contact with the inclined upper portion 522 of the arms 500 for guiding the wall portion onto the support pads 400. As a non-limiting example, this could be the case wherein the lower end of the wall portion is misaligned with the base plate 200. Therefore, the flexibility of the arms 500 combined with the inclined upper portion 522 thereof enables the wall portion to be appropriately guided onto the support pads 400.

Once installed, the wall portion abuts the support surface 402 of the support pads 400. Further, the wall portion is tightly maintained between the first and second set of arms 500 owing to the pressure ribs 518 exerting a squeezing force directed towards the base plate 200. In this configuration, the support pads 400 elevate the wall portion from the base plate 200 to prevent potential moisture from accumulating and to enable air ventilation therebetween. Further, the first inclined surface 218*a* and the second inclined surface 218*b* in collaboration with the draining channels 408 enable to drain water droplets which may form under the wall portion. In this case, water droplets formed under the wall portion fall onto the first inclined surface 218*a* and the second inclined surface 218*b* and are guided along the draining channels 408 towards the first and second lateral sides 210 and 212 of the base plate 200, respectively. The water droplets further fall on the receiving surface 110 and the ventilating channels 302 enable air to be vented between opposing sides of the wall portion for removing the water droplets.

In one non-limiting embodiment of the present technology, the thickness of the central portion of the ventilating sill plate 100 may be less than the side portions thereof and/or the central portion of the ventilating sill plate 100 may be made of a flexible material such as flexible plastic to alleviate the pressure that may be caused by the nailing or screwing of the ventilating sill plate 100 on the floor and/or to prevent material splitting that may be caused by the nail or screw penetration into the ventilating sill plate 100.

Figure 11:
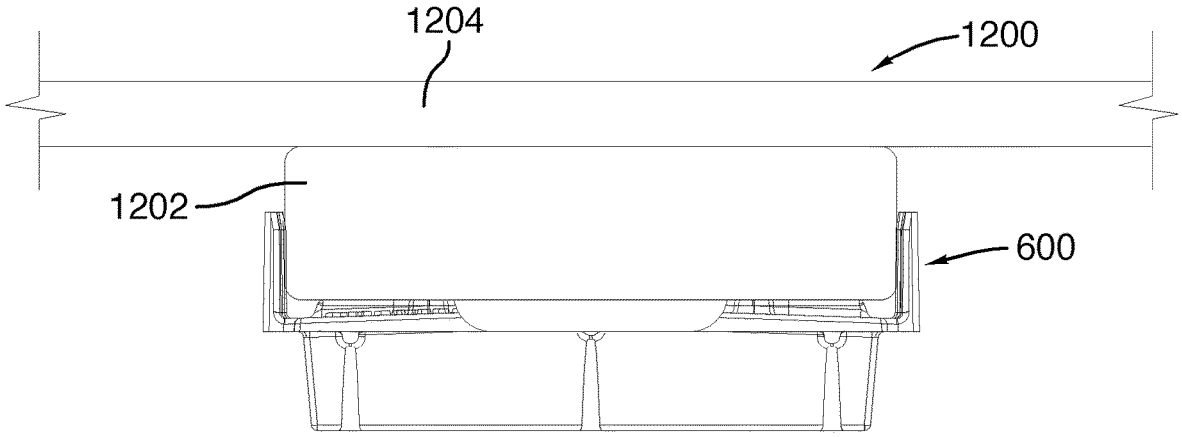
FIG. 11 illustrates an elevated front view of the ventilating sill plate of FIG. 7 in conjunction with a subfloor arrangement in accordance with non-limiting embodiments of the present technology.

FIG. 11 shows the ventilating sill plate 600 illustrated in FIG. 7 and FIG. 8 in conjunction with a subfloor arrangement 1200. A 1"×4" wood beam 1202 is mounted on the ventilating sill plate 600 and snuggly fit between the first set of arms 970 and the second set of arms 980 while a plywood subfloor 1204 is mounted on the wood beam 1202. This arrangement elevates and isolates the wall portion from moisture and humidity that can emanate from the receiving surface 110. In this case, the distance between the first set of arms 970 and the second set of arms 980 is 4". The ventilating sill plate 600 may also be provided in various width to accommodate various wall mounting, as it should become apparent. In another embodiment, the ventilating sill plate 600 may be used under a floor joist for preventing any accumulation of moisture and humidity thereunder.

Figure 12:
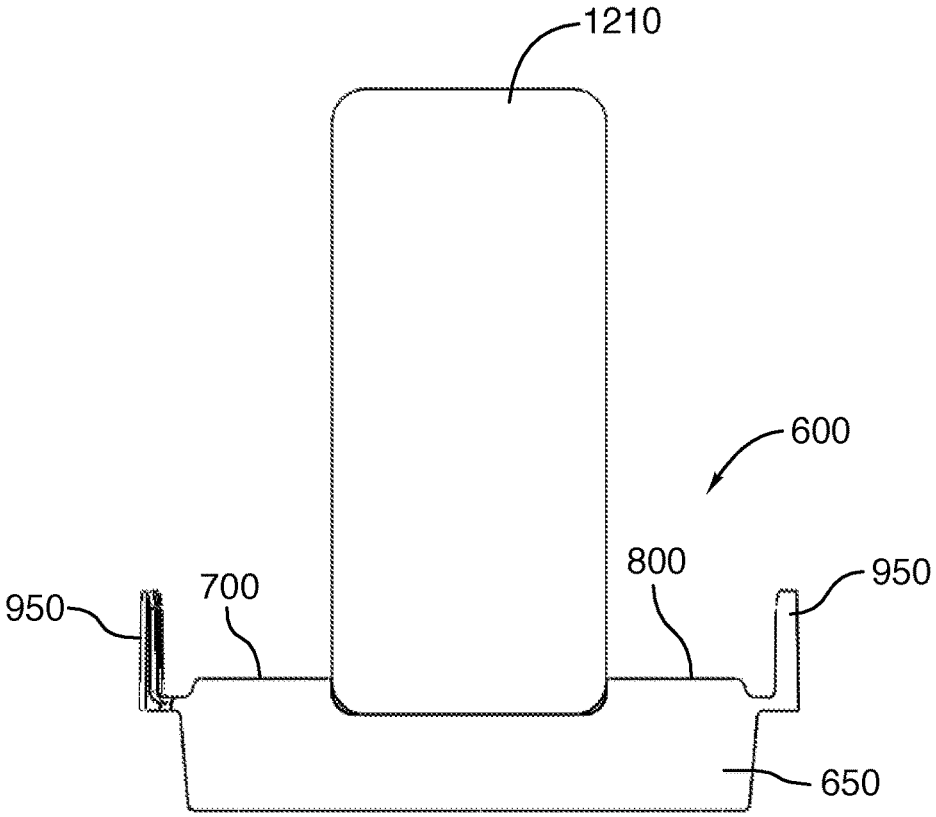
FIG. 12 illustrates an elevated front view of the ventilating sill plate of FIG. 9 in conjunction with a two-by-four wood beam mounted vertically in accordance with non-limiting embodiments of the present technology.

Referring now to FIG. 12, there is shown an alternative use of the ventilating sill plate 600 or 1000 shown in FIG. 7 and FIG. 10 in accordance with non-limiting embodiments of the present technology. Indeed, the ventilating sill plate 600 or 900 is adapted to receive and retain a wall portion (not shown) between the first set of arms 970 and the second set of arms 980, as detailed previously. However, it is also adapted to alternatively receive a thinner wood beam 1210. In the illustrated exemplary embodiment, the distance between the first set of arms 970 and the second set of arms 980 is 4" while the width between the first longitudinal base 700 and the second longitudinal base 800 is 2". In such an embodiment, a 2"×4" wood beam 1210 can be mounted horizontally between the arms, or the same 2"×4" wood beam 1210 can be mounted vertically. In this latter case, the wood beam 1210 is not supported on the first and second longitudinal bases 700, 800. Rather, the wood beam 1210 is mounted between the first and second longitudinal bases 700, 800. With the ventilating sill plate 600 of FIG. 2, i.e. without the central longitudinal base 1100, the wood beam 1210 is mounted on the central portion of the top faces of the support legs 650. Rounded connecting portions 672, 673 previously detailed acts as guiding surfaces to ensure the wood beam 1210 is correctly mounted and held in place. With the ventilating sill plate 600 of FIG. 6, i.e. with the central longitudinal base 1100, the wood beam 1210 is directly mounted on the central longitudinal base 1100. Since the central longitudinal base 1100 defines a recess portion 1106 between its first face 1104 and the first faces 702, 802 of the first and second longitudinal bases 700, 800, the rounded connecting portions 672, 674 act as guiding surfaces to ensure the wood beam 1210 is correctly mounted and held in place on the central longitudinal base 1100. As it should be apparent, when the ventilating sill plate is not provided with connecting portions 672, 674 on the second lateral side 712 of the first longitudinal base 700 and the first lateral side 812 of the second longitudinal base 800, acts similarly to guide and hold in place the wood beam 1210.

While the above description refers to a 2"×4" wood beam, it should be understood that the ventilating sill plate may be adapted to receive beams or structures having other dimensions such as a 1.5"×3.5" beam. Similarly, while the description refers to a beam made of wood, it should be understood that the ventilating sill plate may receive structures or beams made of material other than wood.

In one non-limiting embodiment of the present technology, the ventilating sill plate 100 may be made of a material flexible enough to allow the ventilating sill plate 100 to be rolled along its length. In this case, long ventilating sill plates 100 such as 25 feet ventilating sill plates may be manufactured to be easily stored and transported.

In one non-limiting embodiment of the present technology, at least two ventilating sill plates 100 may be positioned one on top of the other for levelling floor to wall uneven surfaces.

The invention claimed is:

1. A ventilating sill plate for elevating a wall portion from a receiving surface, the ventilating sill plate comprising:

a longitudinal base having a first face and a second face each extending along a longitudinal axis between a first longitudinal end and a second longitudinal end, the longitudinal base further extending laterally in a direction perpendicular to the longitudinal axis between a first lateral side and a second lateral side;

a plurality of longitudinally spaced support legs extending from the second face of the longitudinal base and extending laterally and continuously between the first lateral side and the second lateral side, the plurality of spaced support legs defining ventilating channels each extending continuously between the first lateral side and the second lateral side;

a plurality of longitudinally spaced elevated support pads projecting from the first face, the plurality of spaced elevated pads each comprising a support surface configured to support the wall portion; and a plurality of arms comprising a first set of longitudinally spaced arms projecting from the first face at the first lateral side of the base and a second set of longitudinally spaced arms projecting from the first face at the second lateral side of the at least one longitudinal base, a distance between the first set of arms and the second set of arms configured to receive the wall portion.

2. A ventilating sill plate for elevating a wall portion from a receiving surface, the ventilating sill plate comprising:

at least one longitudinal base having a first face and a second face opposite the first face, the first face and the second face extending along a longitudinal axis, the first face and the second face extending laterally in a direction perpendicular to the longitudinal axis between a first lateral side and a second lateral side;

a plurality of longitudinally spaced support legs projecting away from the second face of the at least one longitudinal base and extending laterally and continuously between the first lateral side and the second lateral side, two adjacent ones of the plurality of longitudinally spaced support legs defining a ventilating channel extending therebetween, the ventilating channel extending laterally and continuously between the first lateral side and the second lateral side;

a plurality of longitudinally spaced elevated support pads each projecting from the first face and each comprising a support surface collaborating for supporting the wall portion; and a plurality of arms comprising a first set of longitudinally spaced arms and a second set of longitudinally spaced arms, the first set of longitudinally spaced arms projecting away from the first face of the at least one longitudinal base and mounted adjacent to the first lateral side, the second set of longitudinally spaced arms projecting away from the first face of the at least one longitudinal base and mounted adjacent to the second lateral side, the first set of longitudinally spaced arms and the second set of longitudinally spaced arms being designed so as to receive the wall portion therebetween.

3. The ventilating sill plate of claim 2, wherein the second face of the at least one longitudinal base comprises at least one longitudinal reinforcement member extending along the longitudinal axis between a first longitudinal end and a second longitudinal end of the at least one longitudinal base.

4. The ventilating sill plate of claim 2, wherein each support pad extends between the first lateral side and the second lateral side of the at least one longitudinal base and comprises at least one reinforcement section.

5. The ventilating sill plate of claim 2, wherein two consecutive support pads of the plurality of support pads define a draining channel extending between the first lateral side and the second lateral side of the at least one longitudinal base.

6. The ventilating sill plate of claim 2, wherein the first set of arms is in a staggered arrangement relative to the second set of arms.

7. The ventilating sill plate of claim 2, wherein each arm of the plurality of arms is L-shaped.

8. The ventilating sill plate of claim 2, wherein each arm of the plurality of arms comprises a pressure surface facing the at least one longitudinal base and parallel to the longitudinal axis, the pressure surface extending between a lower portion connected to the at least one longitudinal base and an upper portion, the pressure surface comprising at least one pressure rib projecting therefrom towards the at least one longitudinal base and configured to contact the wall portion as it is positioned on the support pads.

9. The ventilating sill plate of claim 2, wherein the plurality of arms are flexible in a plane perpendicular to the longitudinal axis.

10. The ventilating sill plate of claim 2, wherein the at least one longitudinal base comprises a single longitudinal plate having the first face and the second face and extending laterally between the first lateral side and the second lateral side.

11. The ventilating sill plate of claim 10, wherein the plurality of longitudinally spaced elevated support pads extend between the first lateral side and the second lateral side of the at least one longitudinal base.

12. The ventilating sill plate of claim 10, wherein the first face of the single longitudinal plate is inclined so as to allow evacuation of water.

13. The ventilating sill plate of claim 12, wherein the first face of the single longitudinal plate is provided with a V-shape so that a first portion of the first face is inclined from an apex towards the first lateral side and a second portion of the first face is inclined from the apex towards the second lateral side.

14. The ventilating sill plate of claim 2, wherein:

the at least one longitudinal base comprises a first longitudinal base and a second longitudinal base, the first longitudinal base being spaced apart from the second longitudinal base along a lateral axis by a gap;

the first longitudinal base is provided with a first surface and a second surface opposite the first surface, the first surface and the second surface extending along the longitudinal axis;

the second longitudinal base is provided with a third surface and a fourth surface opposite the second surface, the third surface and the fourth surface extending along the longitudinal axis;

the first set of longitudinally spaced arms each project away from a first surface of the first longitudinal base adjacent a first lateral end of the first longitudinal base;

the second set of longitudinally spaced arms each project away from a third surface of the second longitudinal base adjacent a first lateral end of the second longitudinal base, the first lateral end of the first longitudinal base being laterally opposite to the first lateral end of the second longitudinal base;

each one of the a plurality of longitudinally spaced support legs is mounted to the second surface of the first longitudinal base and the fourth surface of the second longitudinal base; and each one of the plurality of longitudinally spaced elevated support pads is mounted on a respective one of the first surface of the first longitudinal base and the third surface of the second longitudinal base.

15. The ventilating sill plate of claim 14, wherein:

the plurality of longitudinally spaced elevated support pads comprises a first set of supporting pads projecting from the first surface of the first longitudinal base and a second set of supporting pads projecting from the third surface of the second longitudinal base, each one of the first set of supporting pads laterally facing a respective one of the second set of mounting pads.

16. The ventilating sill plate of claim 14, wherein:

each one of the plurality of longitudinally spaced support legs is provided with a recess facing the gap between the first and second longitudinal bases.

17. The ventilating sill plate of claim 16, wherein:

the at least one longitudinal base further comprises a central longitudinal base mounted to the plurality of longitudinally spaced support legs within the recess thereof, the central longitudinal base being spaced apart from the first and second longitudinal bases.

18. The ventilating sill plate of claim 17, further comprising a plurality of notches each securing the central longitudinal base to a respective one of the first and second longitudinal bases.

19. A ventilating sill plate for elevating a wall portion from a receiving surface, the ventilating sill plate comprising:

a first and a second longitudinal bases, each of the longitudinal bases having a first face and a second face each extending along a longitudinal axis between a first longitudinal end and a second longitudinal end, each of the longitudinal bases further extending laterally in a direction perpendicular to the longitudinal axis between a first lateral side and a second lateral side, the first and second longitudinal bases being operatively mounted side by side in a spaced apart relationship;

a plurality of longitudinally spaced support legs projecting vertically away from the second face of each of the bases and extending laterally and continuously between the first lateral side and the second lateral side, the plurality of spaced support legs defining ventilating channels therebetween, each one of the ventilating channels extending continuously between the first lateral side and the second lateral side;

a plurality of elevated support pads comprising a first set of longitudinally spaced support pads projecting from the first face of the first longitudinal base and a second set of longitudinally spaced support pads projecting from the first face of the second longitudinal base, each of the elevated pads comprising a support surface adapted for supporting the wall portion thereon; and a plurality of arms defining a first set of longitudinally spaced arms projecting from the first face at a corresponding lateral side of the first base projecting outwards and a second set of longitudinally spaced arms projecting from the first face at a corresponding lateral side of the second base projecting outwards, a distance between the first set of arms and the second set of arms being adapted to receive the wall portion.

20. The ventilating sill plate of claim 19, further comprising a central longitudinal base longitudinally mounted between the first and second longitudinal bases, the central base having a first face defining a recessed portion between the first faces of the first longitudinal base and the second longitudinal base.

* * * * *